US007090476B2

(12) United States Patent
Kimura et al.

(10) Patent No.: US 7,090,476 B2
(45) Date of Patent: Aug. 15, 2006

(54) ROTARY FLUID MACHINE

(75) Inventors: Yasunari Kimura, Wako (JP); Tsuneo Endoh, Wako (JP); Tsutomu Takahashi, Wako (JP)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 157 days.

(21) Appl. No.: 10/489,177

(22) PCT Filed: Sep. 20, 2002

(86) PCT No.: PCT/JP02/09717

§ 371 (c)(1),
(2), (4) Date: Sep. 21, 2004

(87) PCT Pub. No.: WO03/027437

PCT Pub. Date: Apr. 3, 2003

(65) Prior Publication Data

US 2005/0025653 A1 Feb. 3, 2005

(30) Foreign Application Priority Data

Sep. 21, 2001 (JP) ..... 2001-289384

(51) Int. Cl.
*F03C 2/00* (2006.01)
*F04C 18/00* (2006.01)

(52) U.S. Cl. ..... 418/268; 418/76; 418/82; 418/98; 418/259; 384/322; 384/372

(58) Field of Classification Search ..... 418/76, 418/82, 98, 259, 268; 384/322, 372, 373, 384/377

See application file for complete search history.

(56) References Cited

U.S. PATENT DOCUMENTS

| | | | | | |
|---|---|---|---|---|---|
| 3,359,731 | A | * | 12/1967 | Anderson | 384/398 |
| 4,255,098 | A | * | 3/1981 | Hertell | 418/76 |
| 4,459,091 | A | * | 7/1984 | Hertell | 418/259 |
| 4,498,301 | A | * | 2/1985 | Tsubouchi | 60/657 |
| 6,240,730 | B1 | | 6/2001 | Thiele | |

FOREIGN PATENT DOCUMENTS

| | | | |
|---|---|---|---|
| EP | 50959 | A1 | 5/1982 |
| JP | 8-200268 | A | 8/1996 |
| JP | 2000-320543 | A | 11/2000 |
| WO | WO 00/53926 | A1 | 3/2000 |

* cited by examiner

*Primary Examiner*—Theresa Trieu
(74) *Attorney, Agent, or Firm*—Birch, Stewart, Kolasch & Birch, LLP

(57) ABSTRACT

A rotary fluid machine is provided in which a rotating shaft (113) fixed to a rotor (41) is rotatably supported on a fixed shaft (102) fixed to a casing (11), sliding surfaces of the fixed shaft (102) and the rotating shaft (113) are lubricated by a first pressurized liquid-phase working medium, and sliding surfaces of the rotor (41) and a vane (48) are lubricated by a second pressurized liquid-phase working medium. By setting the pressure of the first pressurized liquid-phase working medium, which is supplied from an eleventh water passage (W11), comparatively low and setting the pressure of the second pressurized liquid-phase working medium, which is supplied from a first water passage (W1), comparatively high, wasteful leakage of the liquid-phase working medium past the sliding surfaces of the fixed shaft (102) and the rotating shaft (113), where a comparatively small load is applied, can be prevented while enabling the sliding surfaces of the rotor (41) and the vane (48), where a large load is applied, to be reliably lubricated with a high pressure liquid-phase working medium.

2 Claims, 21 Drawing Sheets

ROTARY FLUID MACHINE

FIELD OF THE INVENTION

The present invention relates to a rotary fluid machine for interconverting the pressure energy of a gas-phase working medium and the rotational energy of a rotor.

BACKGROUND ART

A rotary fluid machine disclosed in Japanese Patent Application Laid-open No. 2000-320543 is equipped with a vane piston unit in which a vane and a piston are combined; the piston, which is slidably fitted in a cylinder provided radially in a rotor, interconverts the pressure energy of a gas-phase working medium and the rotational energy of the rotor via a power conversion device comprising an annular channel and a roller, and the vane, which is radially and slidably supported in the rotor, interconverts the pressure energy of the gas-phase working medium and the rotational energy of the rotor.

In such a rotary fluid machine, a rotating shaft, which is fixed to the rotor, is rotatably supported on a fixed shaft, which is fixed to a casing; a hydrostatic bearing is formed by supplying a liquid-phase working medium to sliding surfaces of the fixed shaft and the rotating shaft, and a hydrostatic bearing is also formed by supplying the liquid-phase working medium to sliding surfaces of the vane and a vane channel. Since the pressures of the liquid-phase working medium that are required for the hydrostatic bearings are different from each other, if high pressure water is supplied to the two hydrostatic bearings so as to suit the hydrostatic bearing that requires a high pressure, there is the problem that leakage of the liquid-phase working medium increases wastefully in the hydrostatic bearing that requires a low pressure, and if low pressure water is supplied to the two hydrostatic bearings so as to suit the hydrostatic bearing that requires a low pressure, there is the problem that a sufficient lubrication function cannot be exhibited in the hydrostatic bearing that requires a high pressure.

DISCLOSURE OF THE INVENTION

The present invention has been achieved under the above-mentioned circumstances, and an object thereof is to ensure a necessary lubrication performance while avoiding wasteful leakage of a liquid-phase working medium by supplying a pressurized liquid-phase working medium at an appropriate pressure to a plurality of lubrication sections of a rotary fluid machine.

In order to achieve the above object, in accordance with a first aspect of the present invention, there is proposed a rotary fluid machine that includes a rotor chamber formed in a casing, a rotor rotatably housed within the rotor chamber, and a plurality of vane piston units supported on the rotor so as to be radially moveable, the vane piston units including a vane that is guided along a vane channel formed in the rotor and slides within the rotor chamber, and a piston that is fitted slidably in a cylinder provided in the rotor and abuts against a non-sliding side of the vane, the pressure energy of a gas-phase working medium and the rotational energy of the rotor being interconverted via a power conversion device by reciprocation of the piston, and the pressure energy of the gas-phase working medium and the rotational energy of the rotor being interconverted by rotation of the vane, characterized in that a rotating shaft fixed to the rotor is rotatably supported on a bearing member and a fixed shaft fixed to the casing, sliding surfaces of the fixed shaft and the bearing member with the rotating shaft are lubricated with a first pressurized liquid-phase working medium, and sliding surfaces of the vane channel and the vane are lubricated with a second pressurized liquid-phase working medium, the pressure of the first pressurized liquid-phase working medium and the pressure of the second pressurized liquid-phase working medium being made different.

In accordance with this arrangement, when the sliding surfaces of the fixed shaft and the bearing member with the rotating shaft are lubricated with the first pressurized liquid-phase working medium, and the sliding surfaces of the vane channel and the vane are lubricated with the second pressurized liquid-phase working medium, since the pressure of the first pressurized liquid-phase working medium and the pressure of the second pressurized liquid-phase working medium are made different, a necessary and sufficient pressure of the pressurized liquid-phase working medium can be supplied to each of the lubrication sections, and it is thus possible to ensure a necessary lubrication performance while avoiding wasteful leakage of the liquid-phase working medium.

Furthermore, in accordance with a second aspect of the present invention, in addition to the first aspect, there is proposed a rotary fluid machine wherein the pressure of the first pressurized liquid-phase working medium is set lower than the pressure of the second pressurized liquid-phase working medium.

In accordance with this arrangement, since the pressure of the first pressurized liquid-phase working medium for lubricating the sliding surfaces of the fixed shaft and the bearing member with the rotating shaft is set lower than the pressure of the second pressurized liquid-phase working medium for lubricating the sliding surfaces of the vane channel and the vane, it is possible to prevent wasteful leakage of the liquid-phase working medium past the sliding surfaces of the fixed shaft and the bearing member with the rotating shaft, where a comparatively small load is applied, while reliably lubricating with a high pressure liquid-phase working medium the sliding surfaces of the vane channel and the vane, where a large load is applied.

Steam and water of an embodiment correspond to the gas-phase working medium and the liquid-phase working medium respectively of the present invention.

BRIEF DESCRIPTION OF THE DRAWINGS

FIG. 1 to FIG. 21D illustrate a first embodiment of the present invention;

FIG. 1 is a schematic view of a waste heat recovery system of an internal combustion engine;

FIG. 2 is a longitudinal sectional view of an expander, corresponding a sectional view along line 2—2 of FIG. 4;

FIG. 3 is an enlarged sectional view around the axis of FIG. 2;

FIG. 4 is a sectional view along line 4—4 of FIG. 2;

FIG. 5 is a sectional view along line 5—5 of FIG. 2;

FIG. 6 is a sectional view along line 6—6 of FIG. 2;

FIG. 7 is a sectional view along line 7—7 of FIG. 5;

FIG. 8 is a sectional view along line 8—8 of FIG. 5;

FIG. 9 is a sectional view along line 9—9 of FIG. 8;

FIG. 10 is a sectional view along line 10—10 of FIG. 3;

FIG. 11 is an exploded perspective view of a rotor;

FIG. 12 is an exploded perspective view of a lubricating water distribution section of the rotor;

FIG. 13 is a schematic view showing cross-sectional shapes of a rotor chamber and the rotor;

FIG. 14 is an enlarged view of an essential part of FIG. 3, showing a rotary valve and a fixed shaft support spring;

FIG. 15 is an enlarged view of an essential part of FIG. 2, showing the outer peripheral face of the fixed shaft;

FIG. 16 is a sectional view along line 16—16 of FIG. 14;

FIG. 19 is a sectional view along line 19—19 of FIG. 14;

FIG. 21A to FIG. 21D are graphs showing relationships between the thermal expansion of the fixed shaft and that of the rotating shaft.

BEST MODE FOR CARRYING OUT THE INVENTION

A first embodiment of the present invention is explained below with reference to FIG. 1 to FIG. 21D.

Figure 1:
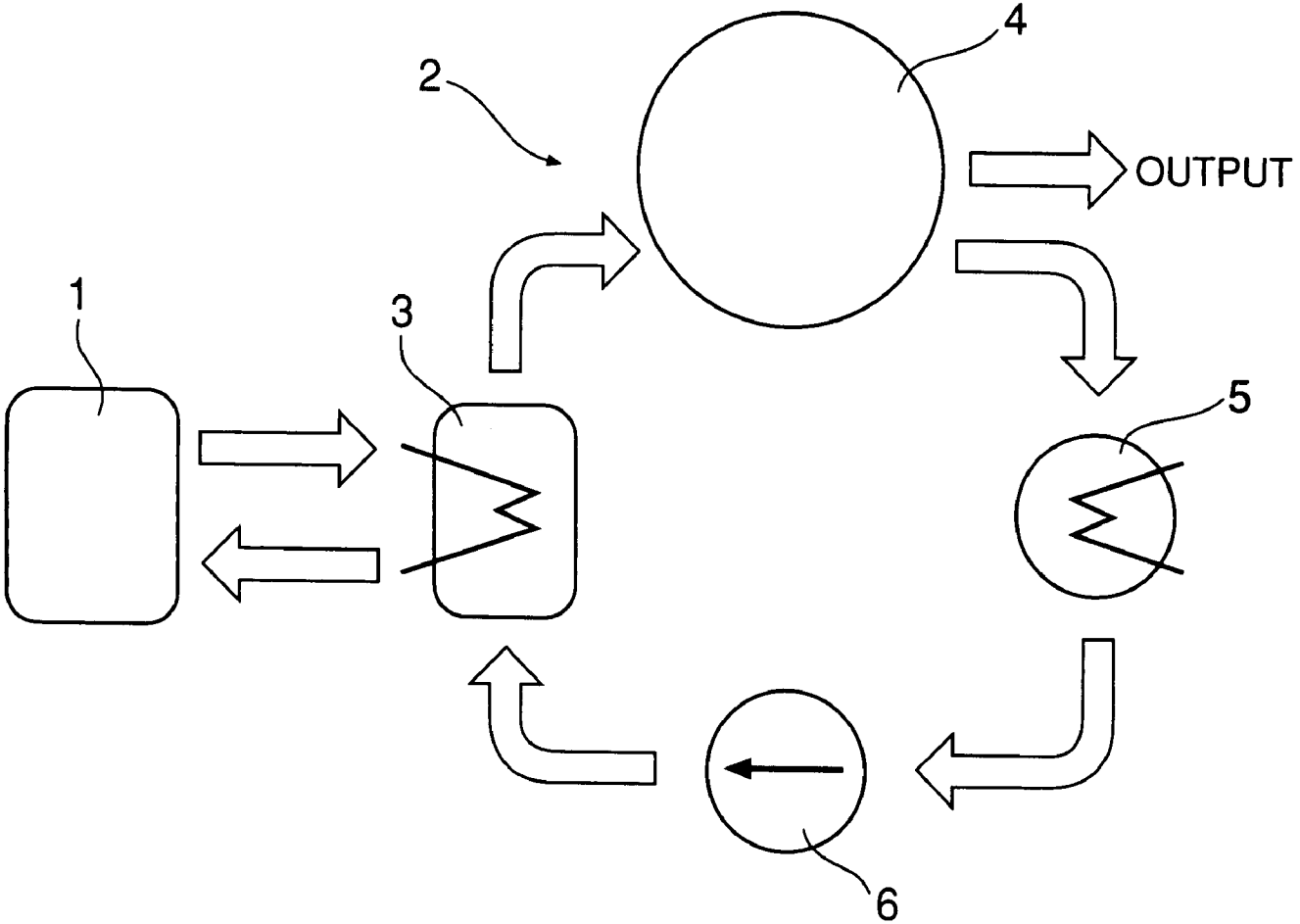

In FIG. 1, a waste heat recovery system 2 for an internal combustion engine 1 includes an evaporator 3 that generates high temperature, high pressure steam by vaporizing a high pressure liquid (e.g. water) using as a heat source the waste heat (e.g. exhaust gas) of the internal combustion engine 1, an expander 4 that generates an output by expansion of the steam, a condenser 5 that liquefies steam having decreased temperature and pressure as a result of conversion of the pressure energy into mechanical energy in the expander 4, and a supply pump 6 that pressurizes the liquid (e.g. water) from the condenser 5 and resupplies it to the evaporator 3.

Figure 2:
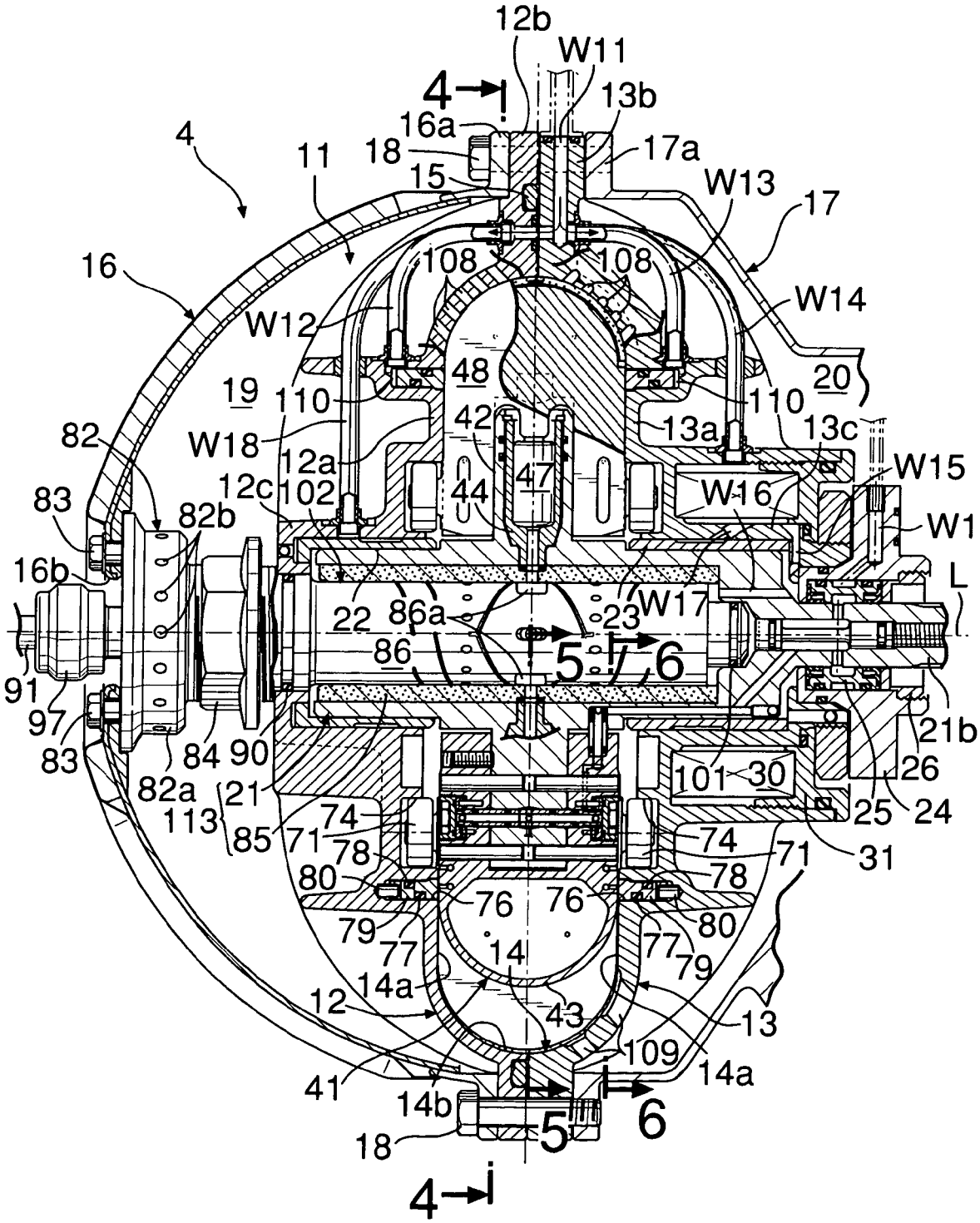
Figure 3:
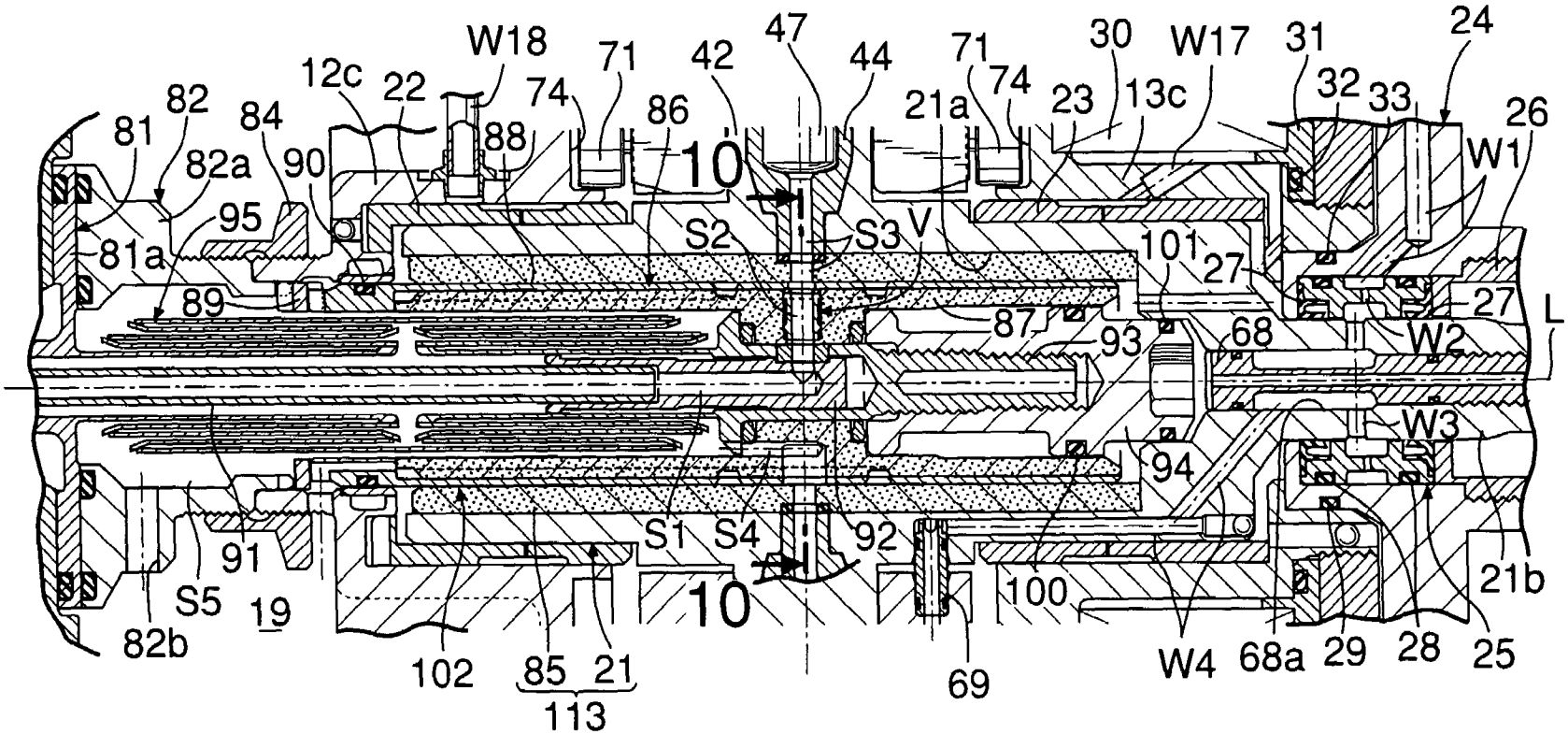

As shown in FIG. 2 and FIG. 3, a casing 11 of the expander 4 is formed from first and second casing halves 12 and 13, which are made of metal. The first and second casing halves 12 and 13 are formed from main body portions 12*a* and 13*a*, which in cooperation form a rotor chamber 14, and circular flanges 12*b* and 13*b*, which are joined integrally to the outer peripheries of the main body portions 12*a* and 13*a*, and the two circular flanges 12*b* and 13*b* are joined together via a metal gasket 15. The outer face of the first casing half 12 is covered with a transit chamber outer wall 16 having a deep bowl shape, and a circular flange 16*a*, which is joined integrally to the outer periphery of the transit chamber outer wall 16, is superimposed on the left face of the circular flange 12*b* of the first casing half 12. The outer face of the second casing half 13 is covered with an exhaust chamber outer wall 17 for housing a magnet coupling (not illustrated) for transmitting the output of the expander 4 to the outside, and a circular flange 17*a*, which is joined integrally to the outer periphery of the exhaust chamber outer wall 17, is superimposed on the right face of the circular flange 13*b* of the second casing half 13. The above-mentioned four circular flanges 12*b*, 13*b*, 16*a*, and 17*a* are tightened together by means of a plurality of bolts 18 disposed in the circumferential direction. A transit chamber 19 is defined between the transit chamber outer wall 16 and the first casing half 12, and an exhaust chamber 20 is defined between the exhaust chamber outer wall 17 and the second casing half 13. The exhaust chamber outer wall 17 is provided with an outlet (not illustrated) for guiding the decreased temperature, decreased pressure steam that has finished work in the expander 4 to the condenser 5.

The main body portions 12*a* and 13*a* of the two casing halves 12 and 13 have hollow bearing tubes 12*c* and 13*c* projecting outward in the lateral direction, and an outer sleeve 21 having a hollow portion 21*a* is rotatably supported by these hollow bearing tubes 12*c* and 13*c* via a pair of bearing members 22 and 23. The axis L of the outer sleeve 21 thus passes through the intersection of the major axis and the minor axis of the rotor chamber 14, which has a substantially elliptical shape. The outer sleeve 21, which is made of metal, forms a rotating shaft 113 in cooperation with a ceramic inner sleeve 85, which will be described later.

A seal block 25 is housed within a lubricating water supply member 24 screwed onto the right-hand end of the second casing half 13, and secured by a nut 26. A small diameter portion 21*b* at the right-hand end of the outer sleeve 21 is supported within the seal block 25, a pair of seals 27 are disposed between the seal block 25 and the small diameter portion 21*b*, a pair of seals 28 are disposed between the seal block 25 and the lubricating water supply member 24, and a seal 29 is disposed between the lubricating water supply member 24 and the second casing half 13. A filter 30 is fitted in a recess formed in the outer periphery of the hollow bearing tube 13*c* of the second casing half 13, and is prevented from falling out by means of a filter cap 31 screwed into the second casing half 13. A pair of seals 32 and 33 are provided between the filter cap 31 and the second casing half 13.

Figure 4:
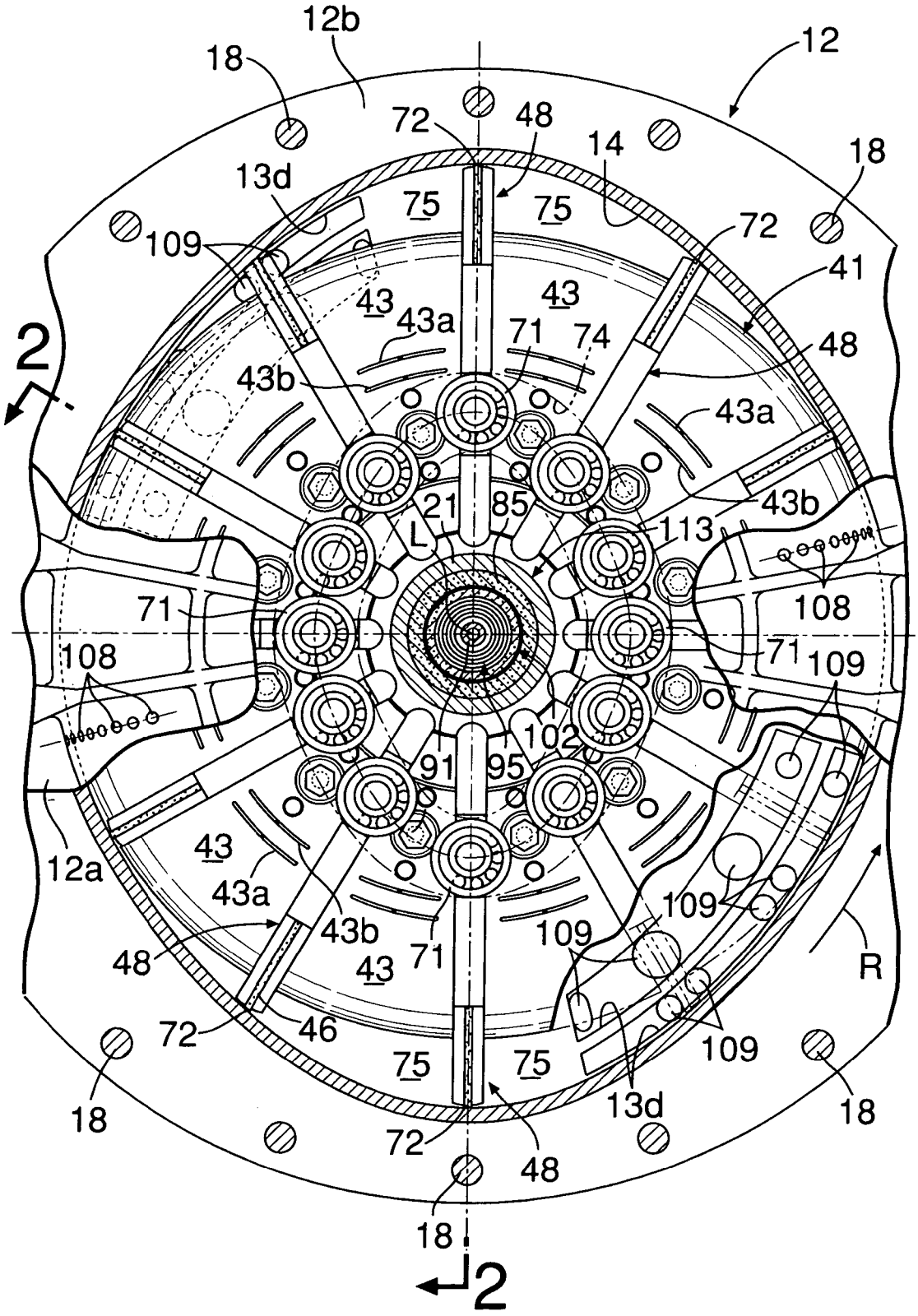
Figure 13:
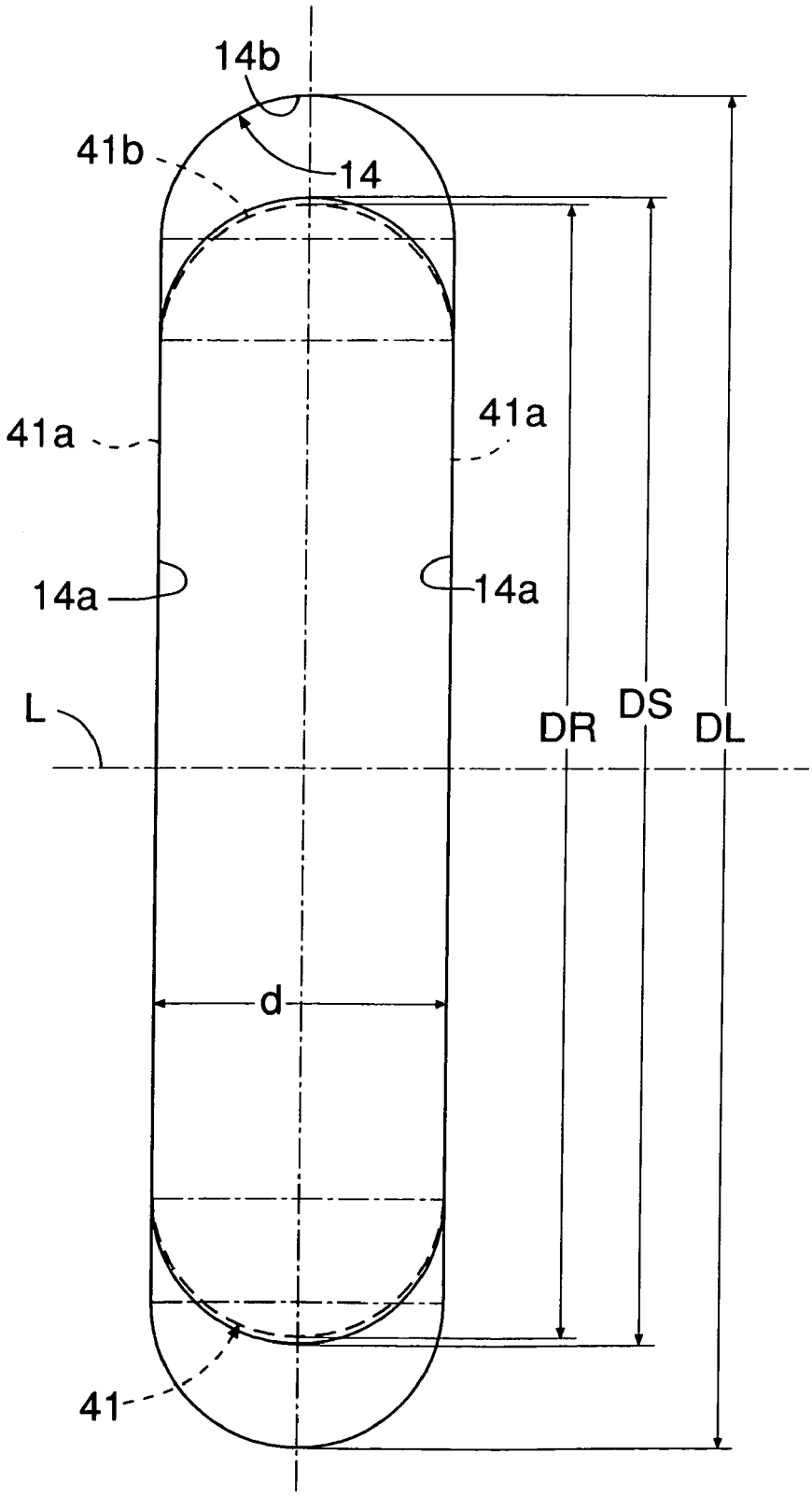

As is clear from FIG. 4 and FIG. 13, a circular rotor 41 is rotatably housed within the rotor chamber 14, which has a pseudo-elliptical shape. The rotor 41 is fitted onto and joined integrally to the outer periphery of the outer sleeve 21, and the axis of the rotor 41 and the axis of the rotor chamber 14 coincide with the axis L of the outer sleeve 21. The shape of the rotor chamber 14 viewed in the axis L direction is pseudo-elliptical, and is similar to a rhombus having four rounded corners, the shape having a major axis DL and a minor axis DS. The shape of the rotor 41 viewed in the axis L direction is a perfect circle having a diameter DR that is slightly smaller than the minor axis DS of the rotor chamber 14.

The cross-sectional shapes of the rotor chamber 14 and the rotor 41 viewed in a direction orthogonal to the axis L are all racetrack-shaped. That is, the cross-sectional shape of the rotor chamber 14 is formed from a pair of flat faces 14*a* extending parallel to each other at a distance d, and arc-shaped faces 14*b* having a central angle of 180° that are smoothly connected to the outer peripheries of the flat faces 14*a* and, similarly, the cross-sectional shape of the rotor 41 is formed from a pair of flat faces 41*a* extending parallel to each other at the distance d, and arc-shaped faces 41*b* having a central angle of 180° that are smoothly connected to the outer peripheries of the flat faces 41*a*. The flat faces 14*a* of the rotor chamber 14 and the flat faces 41*a* of the rotor 41 are in contact with each other, and a pair of crescent-shaped spaces are formed between the inner peripheral face of the rotor chamber 14 and the outer peripheral face of the rotor 41 (see FIG. 4).

The structure of the rotor 41 is now explained in detail with reference to FIG. 3 to FIG. 6, and FIG. 11.

The rotor 41 is formed from a rotor core 42 that is formed integrally with the outer periphery of the outer sleeve 21, and twelve rotor segments 43 that are fixed so as to cover the periphery of the rotor core 42 and form the outer shell of the rotor 41. Twelve ceramic (or carbon) cylinders 44 are mounted radially in the rotor core 42 at 30° intervals and fastened by means of clips 45 to prevent them falling out. A small diameter portion 44*a* is projectingly provided at the inner end of each of the cylinders 44, and a gap between the base end of the small diameter portion 44*a* and the inner sleeve 85 is sealed via a C seal 46. The extremity of the small diameter portion 44*a* is fitted into the outer peripheral face of the hollow inner sleeve 85, and a cylinder bore 44*b* communicates with first and second steam passages S1 and S2 within a fixed shaft 102 via twelve third steam passages S3 running through the small diameter portion 44*a* and the rotating shaft 113. A ceramic piston 47 is slidably fitted within each of the cylinders 44. When the piston 47 moves to the radially innermost position, it retracts completely within the cylinder bore 44*b*, and when it moves to the radially outermost position, about half of the whole length projects outside the cylinder bore 44*b*.

Each of the rotor segments 43 is a hollow wedge-shaped member having a central angle of 30°, and has two recesses 43*a* and 43*b* formed on the faces thereof that are opposite the pair of flat faces 14*a* of the rotor chamber 14, the recesses 43*a* and 43*b* extending in an arc shape with the axis L as the center, and lubricating water outlets 43*c* and 43*d* open in the middle of the recesses 43*a* and 43*b*. Furthermore, four lubricating water outlets 43*e* and 43*f* open on the end faces of the rotor segments 43, that is, the faces that are opposite vanes 48, which will be described later.

The rotor 41 is assembled as follows. The twelve rotor segments 43 are fitted around the outer periphery of the rotor core 42, which is preassembled with the cylinders 44, the clips 45, and the C seals 46, and the vanes 48 are fitted in twelve vane channels 49 formed between adjacent rotor segments 43. At this point, in order to form a predetermined clearance between the vanes 48 and the rotor segments 43, shims having a predetermined thickness are disposed on opposite faces of the vanes 48. In this state, the rotor segments 43 and the vanes 48 are tightened inward in the radial direction toward the rotor core 42 by means of a jig so as to precisely position the rotor segments 43 relative to the rotor core 42, and each of the rotor segments 43 is then provisionally retained on the rotor core 42 by means of provisional retention bolts 50 (see FIG. 8). Subsequently each of the rotor segments 43 and the rotor core 42 are co-machined so as to make two knock pin holes 51 run therethrough, and four knock pins 52 are press-fitted in the two knock pin holes 51 so as to join each of the rotor segments 43 to the rotor core 42.

Figure 8:
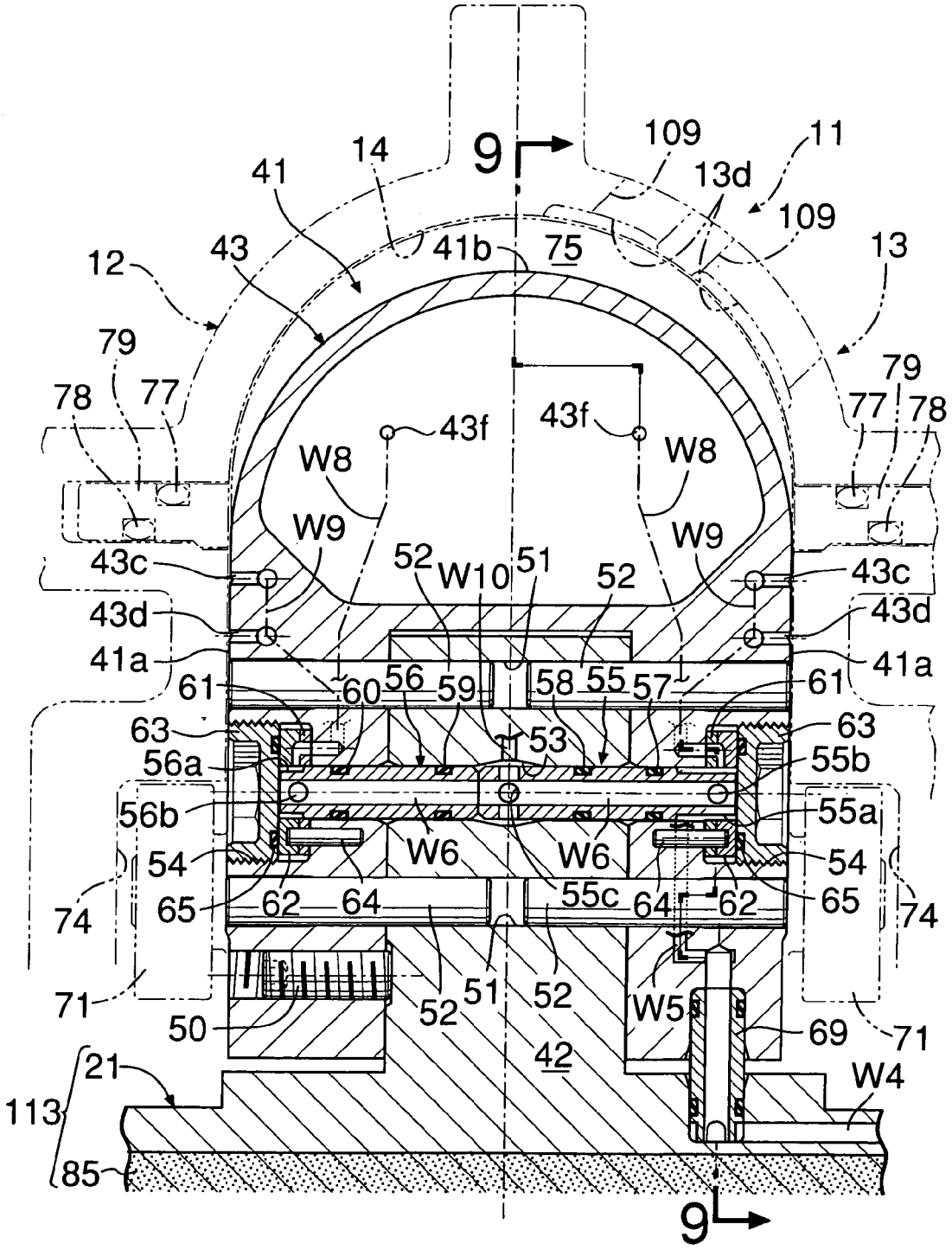
Figure 9:
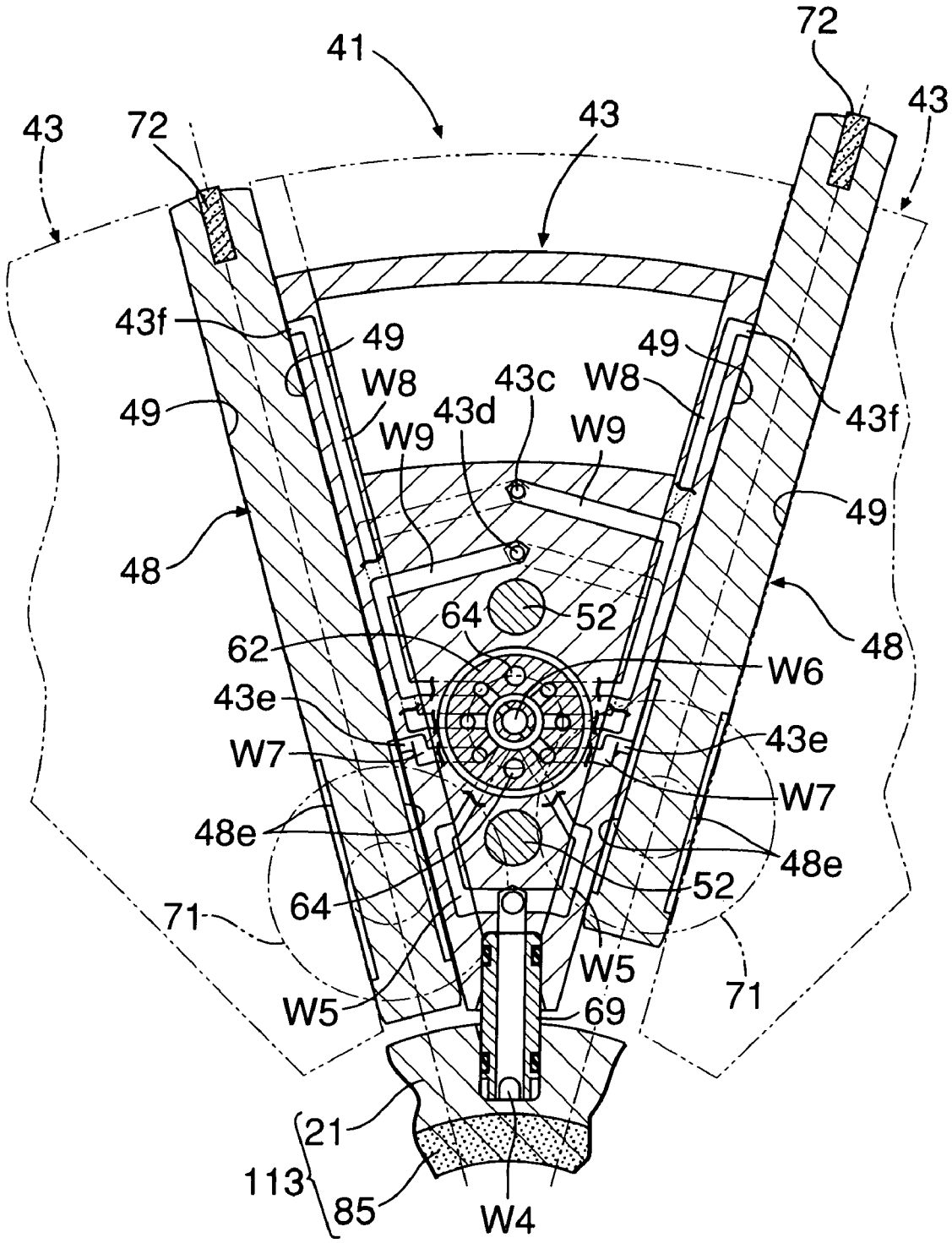
Figure 12:
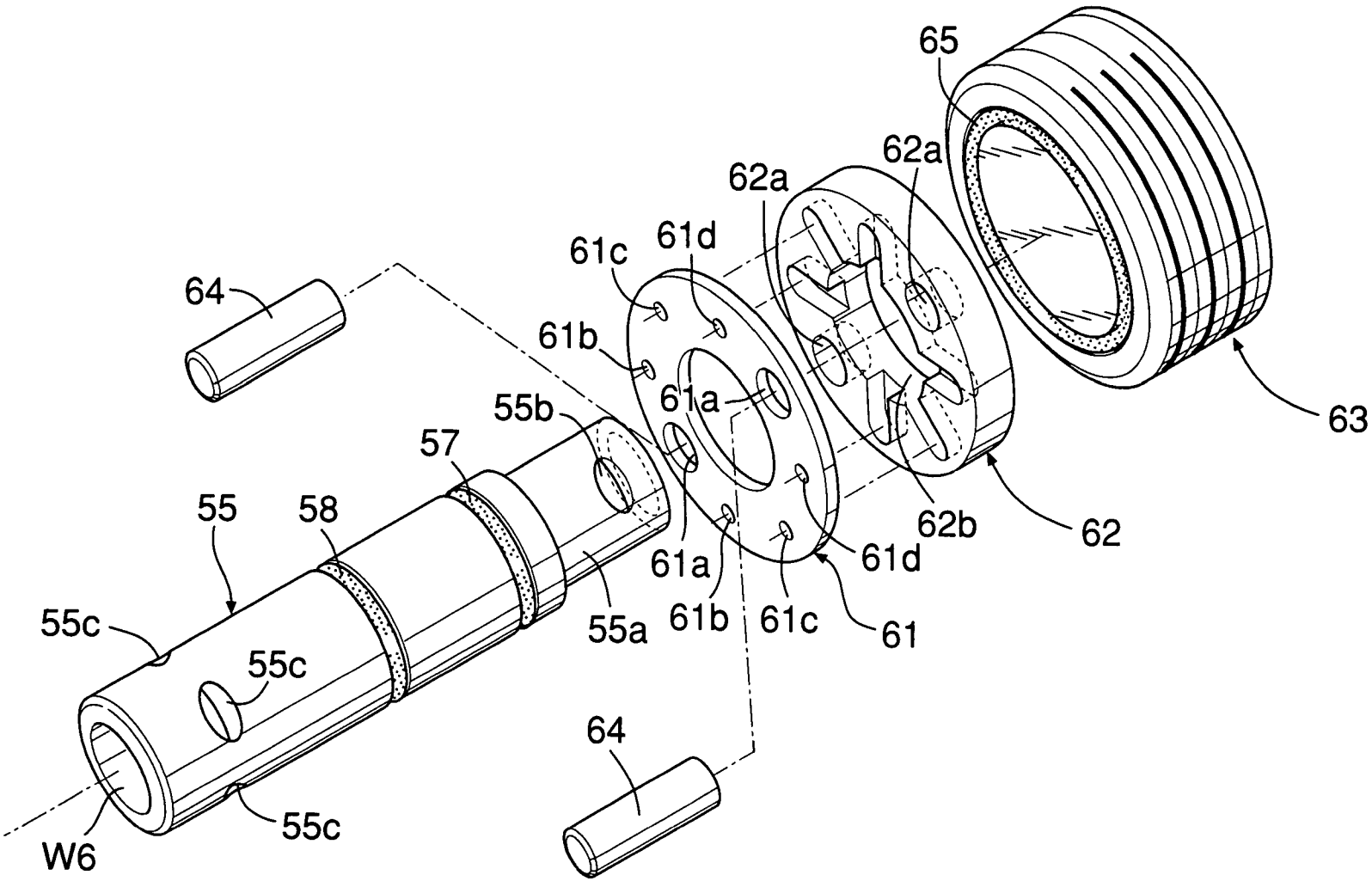

As is clear from FIG. 8, FIG. 9, and FIG. 12, a through hole 53 running through the rotor segment 43 and the rotor core 42 is formed between the two knock pin holes 51, and recesses 54 are formed at opposite ends of the through hole 53. Two pipe members 55 and 56 are fitted within the through hole 53 via seals 57 to 60, and an orifice-forming plate 61 and a lubricating water distribution member 62 are fitted into each of the recesses 54 and secured by a nut 63. The orifice-forming plate 61 and the lubricating water distribution member 62 are prevented from rotating relative to the rotor segments 43 by two knock pins 64 running through knock pin holes 61*a* of the orifice-forming plate 61 and fitted into knock pin holes 62*a* of the lubricating water distribution member 62, and a gap between the lubricating water distribution member 62 and the nut 63 is sealed by an O ring 65.

A small diameter portion 55*a* formed in an outer end portion of one of the pipe members 55 communicates with a sixth water passage W6 within the pipe member 55 via a through hole 55*b*, and the small diameter portion 55*a* also communicates with a radial distribution channel 62*b* formed on one side face of the lubricating water distribution member 62. The distribution channel 62*b* of the lubricating water distribution member 62 extends in six directions, and the extremities thereof communicate with six orifices 61*b*, 61*c*, and 61*d* of the orifice-forming plate 61. The structures of the orifice-forming plate 61, the lubricating water distribution member 62 and the nut 63 provided at the outer end portion of the other pipe member 56 are identical to the structures of the above-mentioned orifice-forming plate 61, lubricating water distribution member 62, and nut 63.

Downstream sides of the two orifices 61*b* of the orifice-forming plate 61 communicate with the two lubricating water outlets 43*e*, which open so as to be opposite the vane 48, via seventh water passages W7 formed within the rotor segments 43; downstream sides of the two orifices 61*c* communicate with the two lubricating water outlets 43*f*, which open so as to be opposite the vane 48, via eighth water passages W8 formed within the rotor segment 43; and downstream sides of the two orifices 61*d* communicate with the two lubricating water outlets 43*c* and 43*d*, which open so as to be opposite the rotor chamber 14, via ninth water passages W9 formed within the rotor segment 43.

Figure 5:
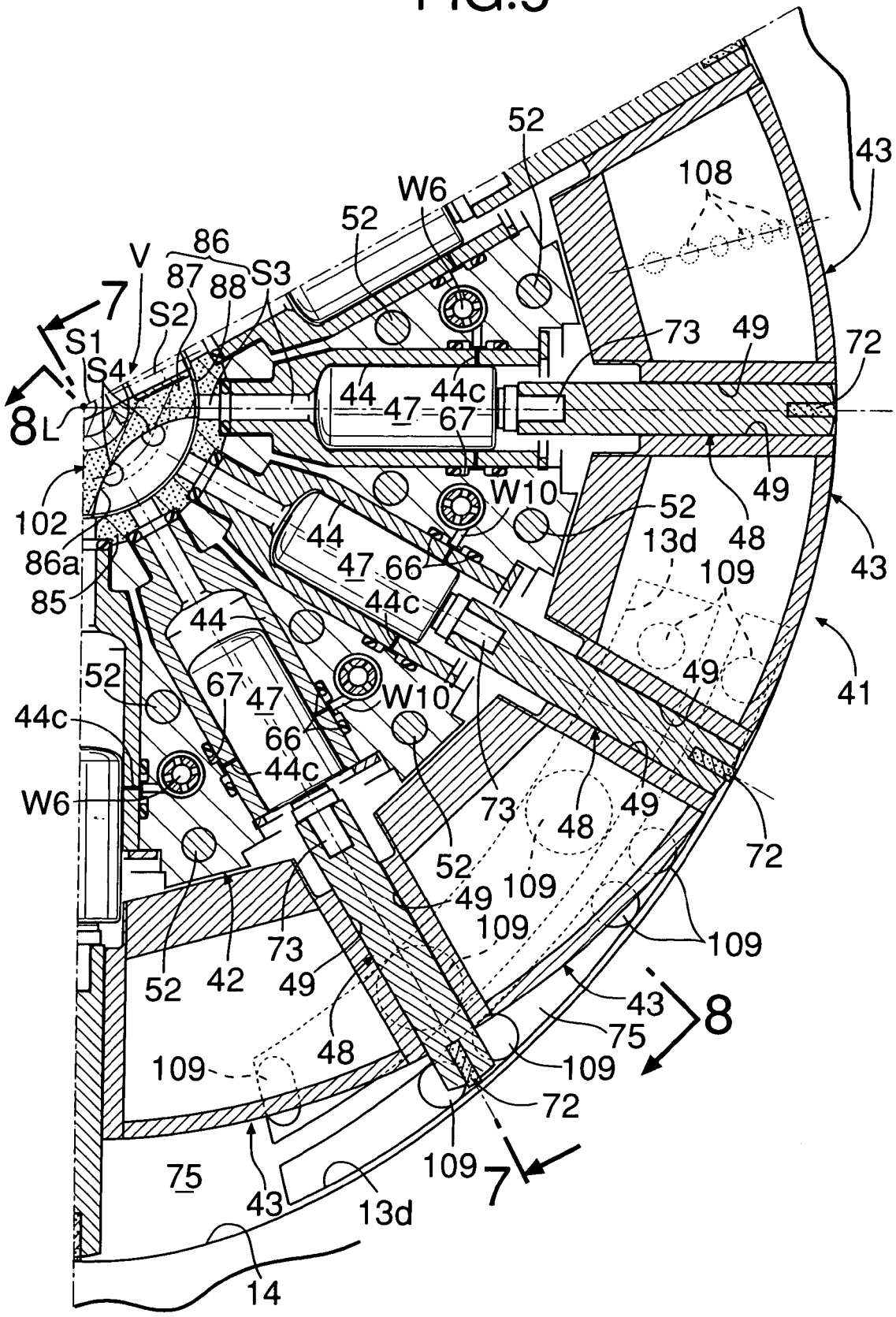
Figure 6:
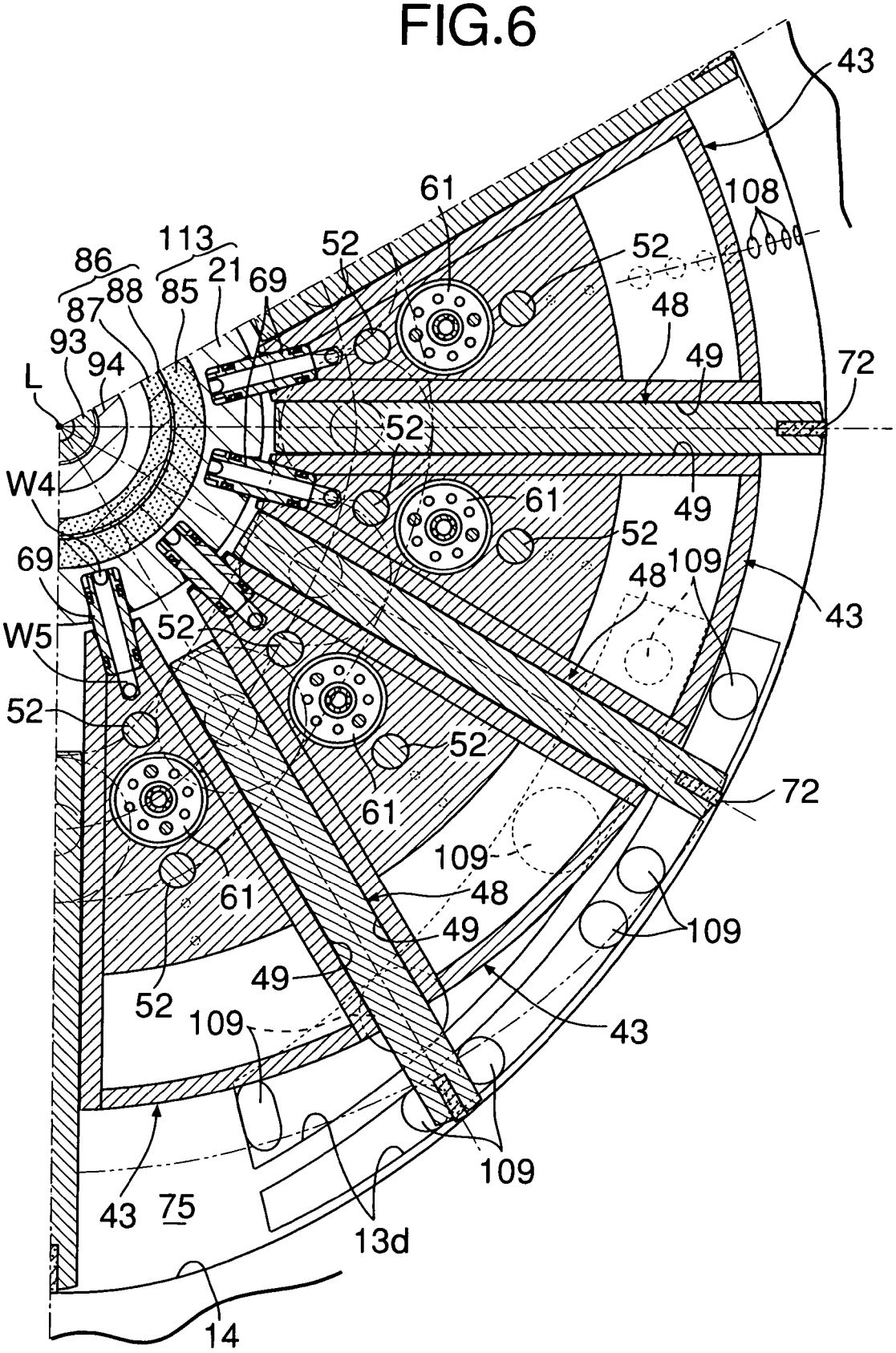

As is clear from reference in addition to FIG. 5, an annular channel 67 is defined by a pair of O rings 66 on the outer periphery of the cylinder 44, and the sixth water passage W6 formed within said one of the pipe members 55 communicates with the annular channel 67 via four through holes 55*c* running through the pipe member 55 and a tenth water passage W10 formed within the rotor core 42. The annular channel 67 communicates with sliding surfaces of the cylinder bore 44*b* and the piston 47 via an orifice 44*c*. The position of the orifice 44*c* of the cylinder 44 is set so that it stays within the sliding surface of the piston 47 when the piston 47 moves between top dead center and bottom dead center.

As is clear from FIG. 3 and FIG. 9, the first water passage W1 formed in the lubricating water supply member 24 communicates with the small diameter portion 55*a* of said one of the pipe members 55 via a second water passage W2 formed in the seal block 25, third water passages W3 formed in the small diameter portion 21*b* of the outer sleeve 21, an annular channel 68*a* formed in the outer periphery of a water passage forming member 68 fitted in the center of the outer sleeve 21, a fourth water passage W4 formed in the outer sleeve 21, a pipe member 69 bridging the rotor core 42 and the rotor segments 43, and fifth water passages W5 formed so as to bypass the knock pin 52 on the radially inner side of the rotor segment 43.

Figure 7:
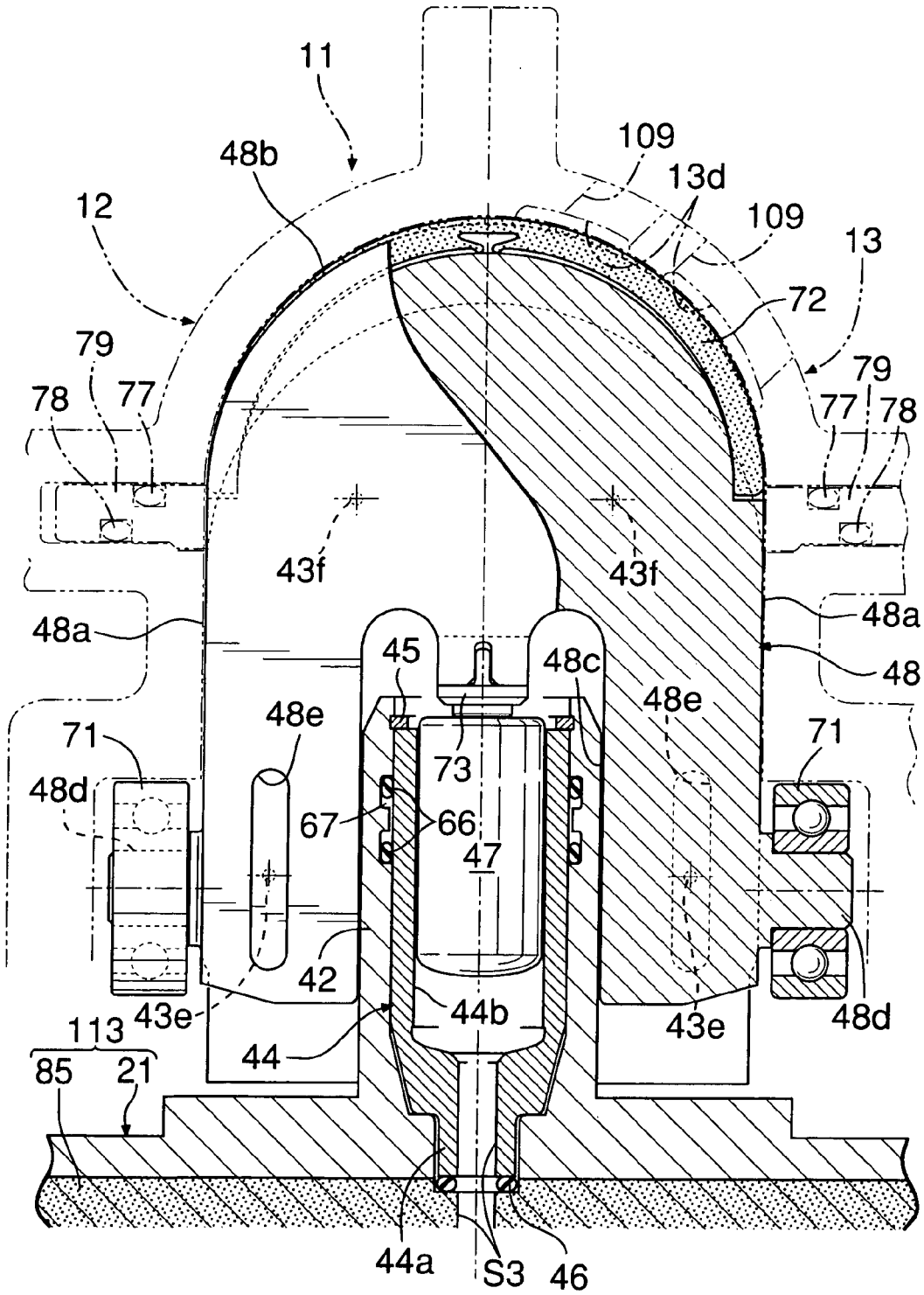
Figure 11:
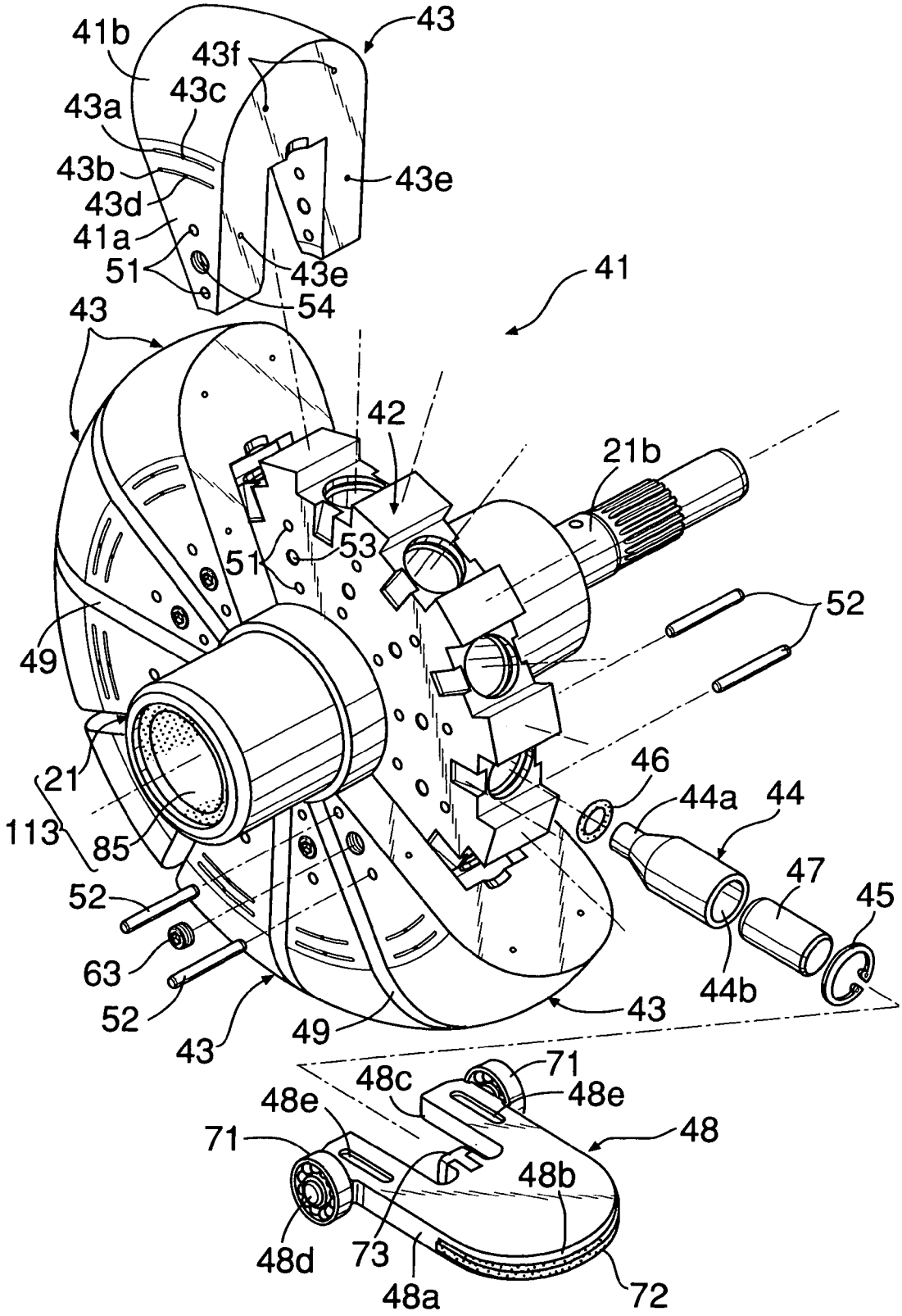

As shown in FIG. 7, FIG. 9, and FIG. 11, twelve vane channels 49 are formed between adjacent rotor segments 43 of the rotor 41 so as to extend in the radial direction, and the plate-shaped vanes 48 are slidably fitted in the respective vane channels 49. Each of the vanes 48 has a substantially U-shaped form comprising parallel faces 48*a* following the parallel faces 14*a* of the rotor chamber 14, an arc-shaped face 48*b* following the arc-shaped face 14*b* of the rotor chamber 14, and a notch 48*c* positioned between the parallel faces 48*a*. Rollers 71 having a roller bearing structure are rotatably supported on a pair of support shafts 48*d* projecting from the parallel faces 48*a*.

A U-shaped synthetic resin seal 72 is retained in the arc-shaped face 48*b* of the vane 48, and the extremity of the seal 72 projects slightly from the arc-shaped face 48*b* of the vane 48 and comes into sliding contact with the arc-shaped face 14*b* of the rotor chamber 14. Two recesses 48*e* are formed on each side of the vane 48, and these recesses 48*e* are opposite the two radially inner lubricating water outlets 43*e* that open on the end faces of the rotor segment 43. A piston receiving member 73, which is provided so as to project radially inward in the middle of the notch 48*c* of the vane 48, abuts against the radially outer end of the piston 47.

As is clear from FIG. 4, two pseudo-elliptical annular channels 74 having a similar shape to that of a rhombus with its 4 apexes rounded are provided in the flat faces 14*a* of the rotor chamber 14 defined by the first and second casing halves 12 and 13, and the pair of rollers 71 of each of the vanes 48 are rollably engaged with these annular channels 74. The distance between these annular channels 74 and the arc-shaped face 14*b* of the rotor chamber 14 is constant throughout the whole circumference. Therefore, when the rotor 41 rotates, the vane 48 having the rollers 71 guided by the annular channels 74 reciprocates radially within the vane channel 49, and the seal 72 mounted on the arc-shaped face 48*b* of the vane 48 slides along the arc-shaped face 14*b* of the rotor chamber 14 with a constant amount of compression. This enables direct physical contact between the rotor chamber 14 and the vanes 48 to be prevented and vane chambers 75 defined between adjacent vanes 48 to be reliably sealed while preventing any increase in the sliding resistance or the occurrence of wear.

As is clear from FIG. 2, a pair of circular seal channels 76 are formed in the flat faces 14*a* of the rotor chamber 14 so as to surround the outside of the annular channels 74. A pair of ring seals 79 equipped with two O rings 77 and 78 are slidably fitted in the circular seal channels 76, and the seal surfaces are opposite the recesses 43*a* and 43*b* (see FIG. 4) formed in each of the rotor segments 43. The pair of ring seals 79 are prevented from rotating relative to the first and second casing halves 12 and 13 by knock pins 80.

As is clear from FIG. 2, FIG. 3, FIG. 10, and FIG. 14, an opening 16*b* is formed at the center of the transit chamber outer wall 16; a boss portion 81*a* of a spring support member 81 and a boss portion 82*a* of a fixed sleeve support member 82 disposed on the axis L are tightened together to the inner face of the opening 16*b* by a plurality of bolts 83, and the fixed sleeve support member 82 is secured to the first casing half 12 by means of a nut 84. The inner sleeve 85, which is formed in a cylindrical shape using a material having a small coefficient of thermal expansion such as ceramic, is fixed in the hollow portion 21*a* of the outer sleeve 21, which is made of metal, by shrink-fitting, and a fixed sleeve 86 is relatively rotatably fitted into the inner peripheral face of the inner sleeve 85. The fixed sleeve 86 is formed from an inner sleeve 87 made of a material having small coefficient of thermal expansion such as ceramic and an outer sleeve 88 made of metal, the outer sleeve 88 being united with the outer periphery of the inner sleeve 87 by shrink-fitting, and the left-hand end of the fixed sleeve 86 is supported by the fixed sleeve support member 82 via an Oldham coupling 89 that allows relative movement in the radial direction. A gap between the fixed sleeve 86 and the first casing half 12 is sealed by a seal 90 at a position close to the Oldham coupling 89.

Disposed within the hollow fixed sleeve 86 are a steam supply pipe 91, a first fixed shaft 92, a second fixed shaft 93, a third fixed shaft 94, and a fixed shaft support spring 95. The steam supply pipe 91, which is disposed on the axis L, runs through the boss portion 81*a* of the spring support member 81 and is secured by a nut 97. The first fixed shaft 92 is a pipe-shaped member having the right-hand end thereof closed, and the right-hand end of the steam supply pipe 91 is fitted into an open portion at the left-hand end of the first fixed shaft 92. The inner sleeve 87 of the fixed sleeve 86 has a thick portion 87*a* projecting radially inward, the second fixed shaft 93, which is a pipe-shaped member having a central portion thereof closed, is held between the inner periphery of the thick portion 87*a* and the outer periphery of the first fixed shaft 92, and seals 98 and 99 are disposed between the thick portion 87*a* of the inner sleeve 87 and the second fixed shaft 93. A threaded portion at the right-hand end of the second fixed shaft 93 is screwed into the inner peripheral face of the third fixed shaft 94, which is a pipe-shaped member having the right-hand end thereof closed, and two seals 100 and 101 provided at the right-hand end of the third fixed shaft 94 are in intimate contact with the inner peripheral face of the inner sleeve 87 of the fixed sleeve 86 and the inner peripheral face of the outer sleeve 21 of the rotating shaft 113.

The fixed sleeve 86, the first fixed shaft 92, the second fixed shaft 93, and the third fixed shaft 94 form the fixed shaft 102 of the present invention.

Figure 14:
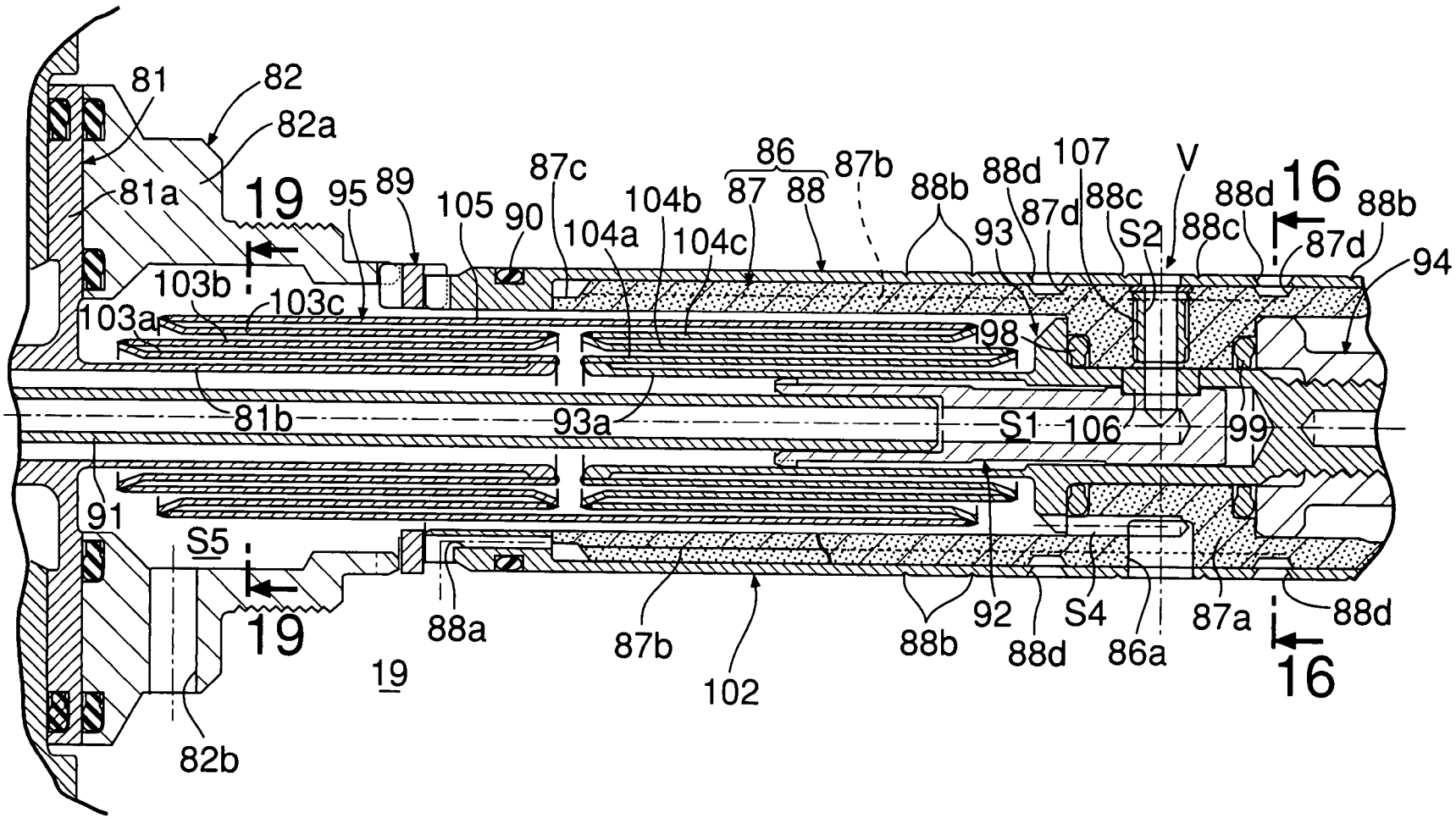
Figure 19:
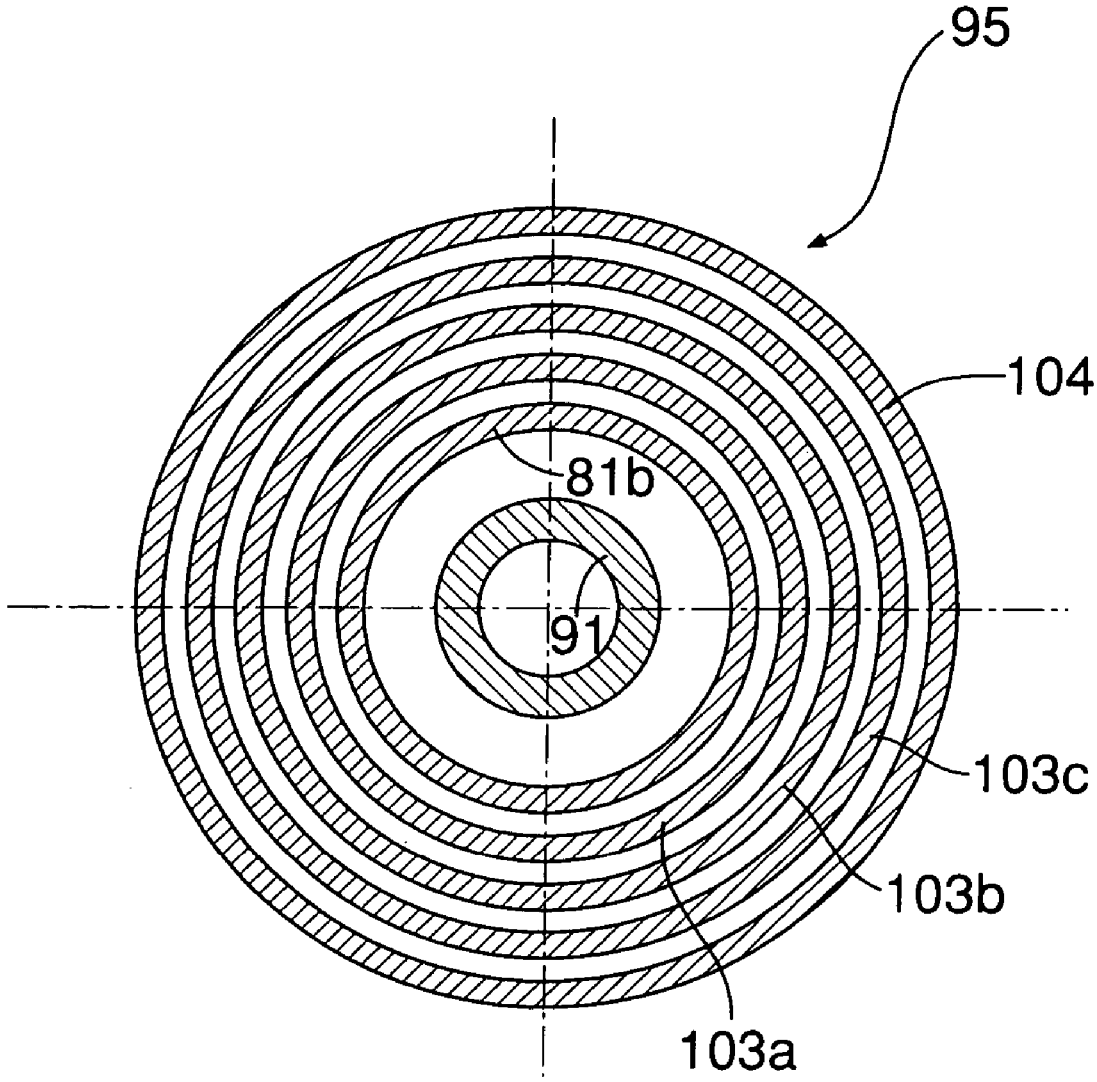

As is most clearly shown in FIG. 14 and FIG. 19, the fixed shaft support spring 95 disposed around the outer periphery of the steam supply pipe 91 provides a connection between a cylindrical spring portion 81*b* forming a multicylindrical support portion extending rightward from the boss portion 81*a* of the spring support member 81 and a cylindrical spring portion 93*a* similarly forming a multicylindrical support portion and extending leftward from the central portion of the second fixed shaft 93. That is, the fixed shaft support spring 95 comprises seven cylindrical springs 103*a*, 103*b*, and 103*c*; 104*a*, 104*b*, and 104*c*; and 105, which are arranged concentrically with the axis L as the center; the three cylindrical springs 103*a*, 103*b*, and 103*c* are fitted around the outer periphery of the cylindrical spring portion 81*b* of the spring support member 81 so that there are gaps therebetween and are welded to each other at the ends; the three cylindrical springs 104*a*, 104*b*, and 104*c* are fitted around the outer periphery of the cylindrical spring portion 93*a* of the second fixed shaft 93 so that there are gaps therebetween and are welded to each other at the ends; and opposite ends of the cylindrical spring 105 on the outermost peripheral side are welded to the cylindrical springs 103*c* and 104*c*, which are on the inside thereof.

Figure 10:
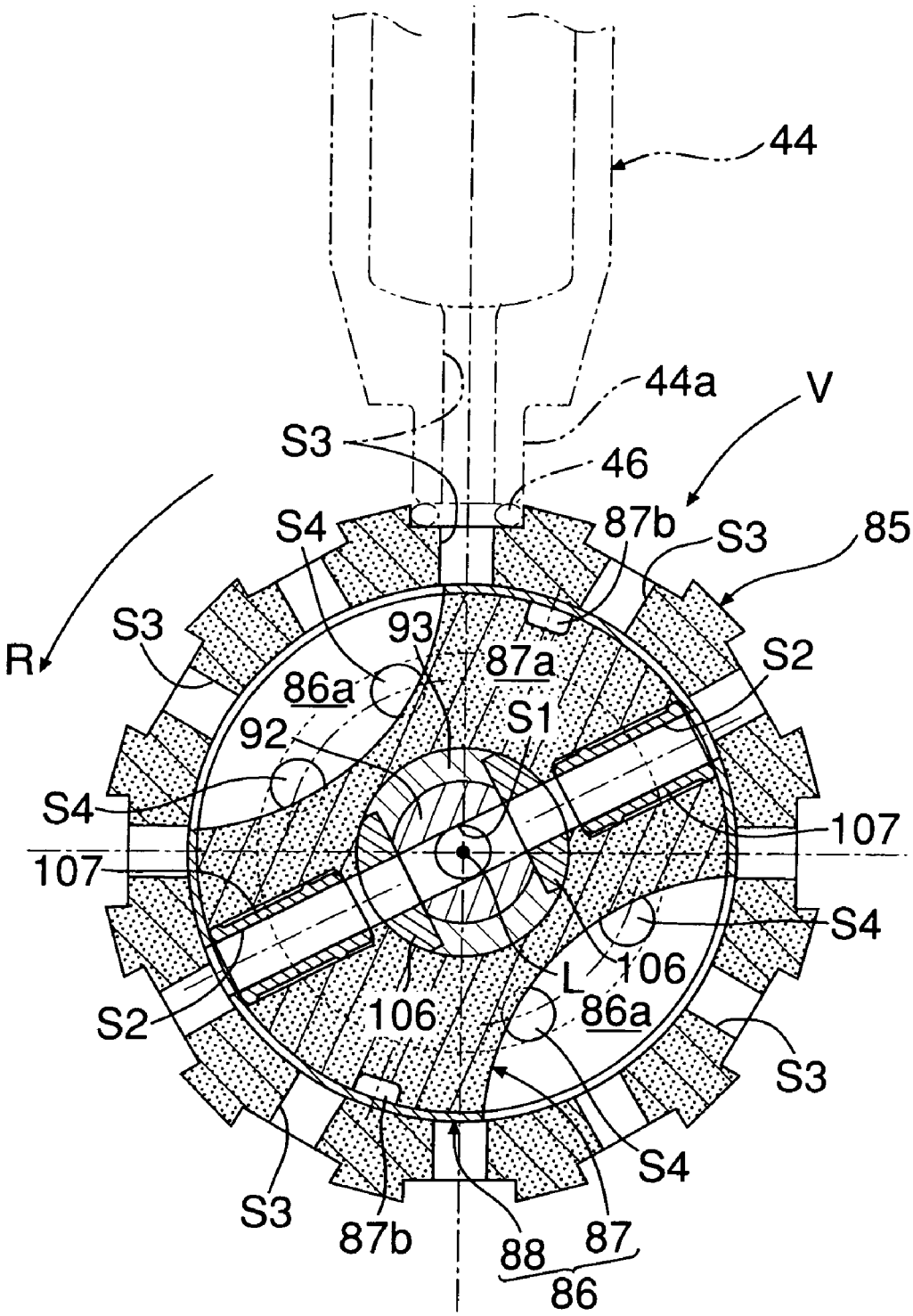

As is clear from FIG. 10 and FIG. 14, two collars 106 are fitted around the second fixed shaft 93, which is sandwiched between the first fixed shaft 92 and the inner sleeve 87, and two nozzle members 107 are fitted in the thick portion 87*a* of the inner sleeve 87. The first steam passage S1, which communicates with the steam supply pipe 91, is formed in the center of the first fixed shaft 92 in the axial direction, and the two second steam passages S2, which pass through the interiors of the collars 106 and the nozzle members 107, run radially through the first fixed shaft 92, the second fixed shaft 93, and the fixed sleeve 86 with a phase difference of 180°. As described above, the twelve third steam passages S3 run through the small diameter portions 44*a* of the twelve cylinders 44 retained at intervals of 30° in the rotor 41 fixed to the rotating shaft 113 and the inner sleeve 85 of the rotating shaft 113, and radially inner end portions of these third steam passages S3 are opposite the radially outer end portions of the second steam passages S2 so as to be able to communicate therewith.

A pair of notches 86*a* are formed on the outer peripheral face of the thick portion 87*a* of the fixed sleeve 86 with a phase difference of 180°, and these notches can communicate with the third steam passages S3. The notches 86*a* and the transit chamber 19 communicate with each other via four fourth steam passages S4 formed axially in the fixed sleeve 86, a fifth steam passage S5 formed within the fixed sleeve 86 and the fixed sleeve support member 82, and through holes 82*b* opening on the outer periphery of the boss portion 82*a* of the fixed sleeve support member 82.

As shown in FIG. 2 and FIG. 4, a plurality of radially aligned intake ports 108 are formed in the first casing half 12 and the second casing half 13 at positions that are advanced by 15° in the direction of rotation R of the rotor 41 relative to the minor axis of the rotor chamber 14. The interior space of the rotor chamber 14 communicates with the transit chamber 19 by means of these intake ports 108. Furthermore, a plurality of exhaust ports 109 are formed in the second casing half 13 at positions that are retarded by 15° to 75° in the direction of rotation R of the rotor 41 relative to the minor axis of the rotor chamber 14. The inner space of the rotor chamber 14 communicates with the exhaust chamber 20 by means of these exhaust ports 109. These exhaust ports 109 open in shallow depressions 13*d* formed within the second casing half 13 so that the seals 72 of the vanes 48 are not damaged by the edges of the exhaust ports 109.

The second steam passages S2 and the third steam passages S3, and the notches 86*a* of the fixed sleeve 86, and the third steam passages S3, form a rotary valve V, which provides periodic communication therebetween by rotation of the rotating shaft 113 relative to the fixed shaft 102 (see FIG. 10).

Figure 17A:
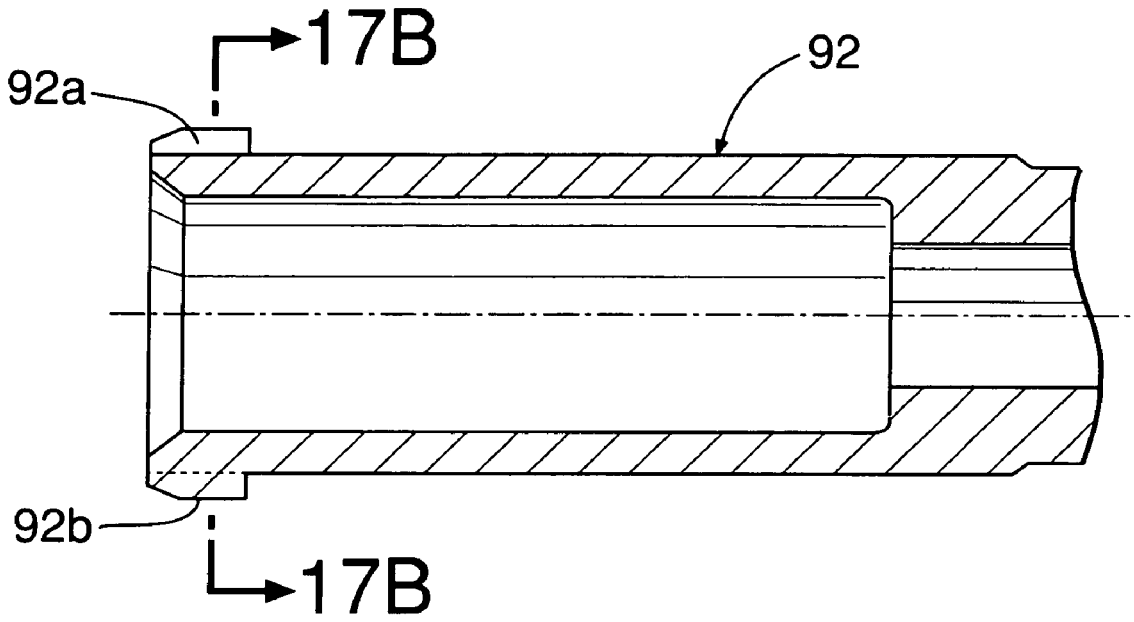
FIG. 17A is an enlarged view of an essential part of a first fixed shaft.
Figure 17B:
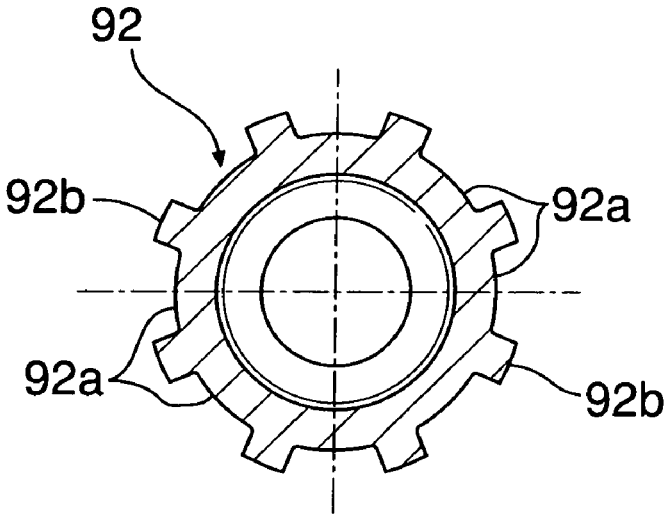
FIG. 17B is a sectional view along line 17B—17B of FIG. 17A.

As is clear from FIG. 17A and FIG. 17B, a plurality of notches 92*a* are formed in a left-hand end outer peripheral portion of the first fixed shaft 92, and convex portions 92*b* formed between the notches 92*a* are in intimate contact with the cylindrical spring 93*a* of the fixed shaft support spring 95. Even when the temperature of the first fixed shaft 92, through which high temperature, high pressure steam passes, increases, by making only the convex portions 92*b* come into contact with the cylindrical spring 93*a*, the heat transmitted to the fixed shaft support spring 95 can be minimized.

Figure 18A:
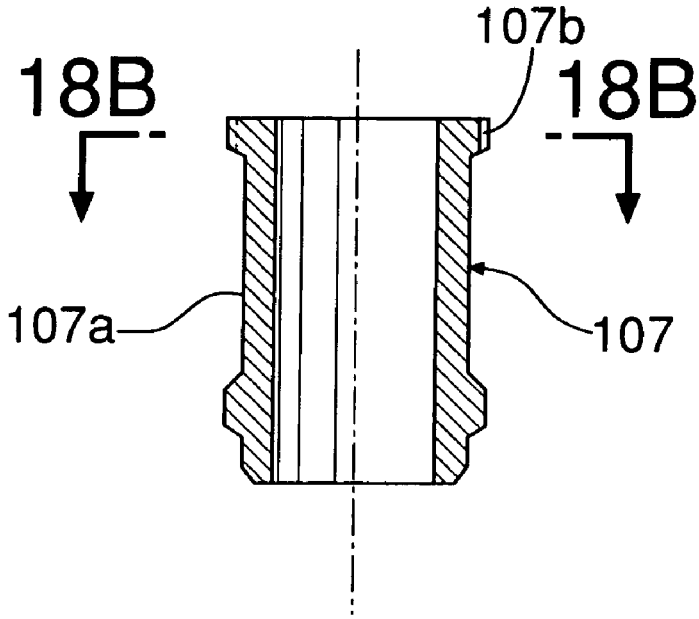
FIG. 18A is an enlarged view of a nozzle member.
Figure 18B:
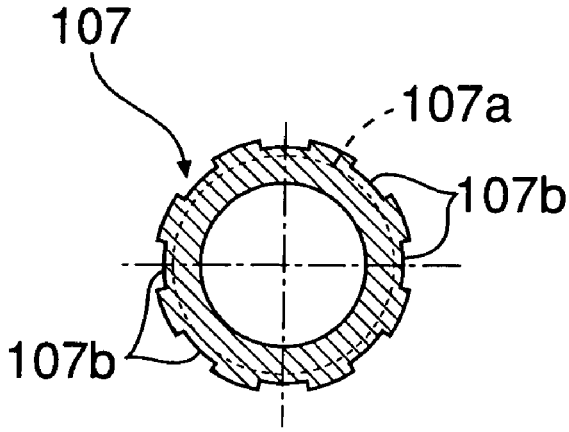
FIG. 18B is a sectional view along line 18B—18B of FIG. 18A.

As is clear from FIG. 18A and FIG. 18B, an annular channel 107*a* is formed on the outer periphery of the nozzle member 107, which is fitted in the inner sleeve 87, and a plurality of notches 107*b* are formed in an end portion of the nozzle member 107. This enables transmission to the inner sleeve 87 of heat of the nozzle member 107, through which high temperature, high pressure steam passes, to be minimized.

Figure 15:
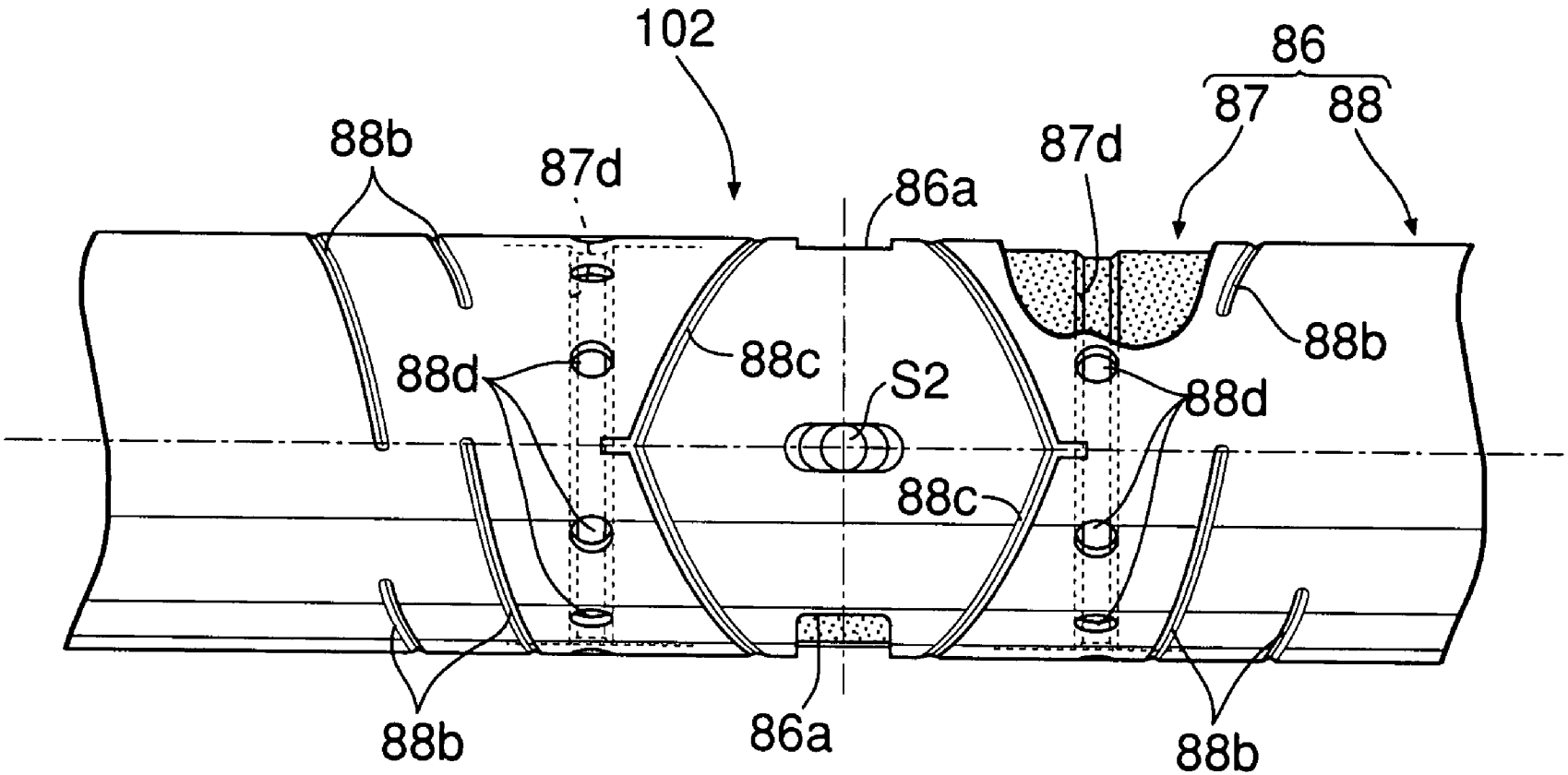
Figure 16:
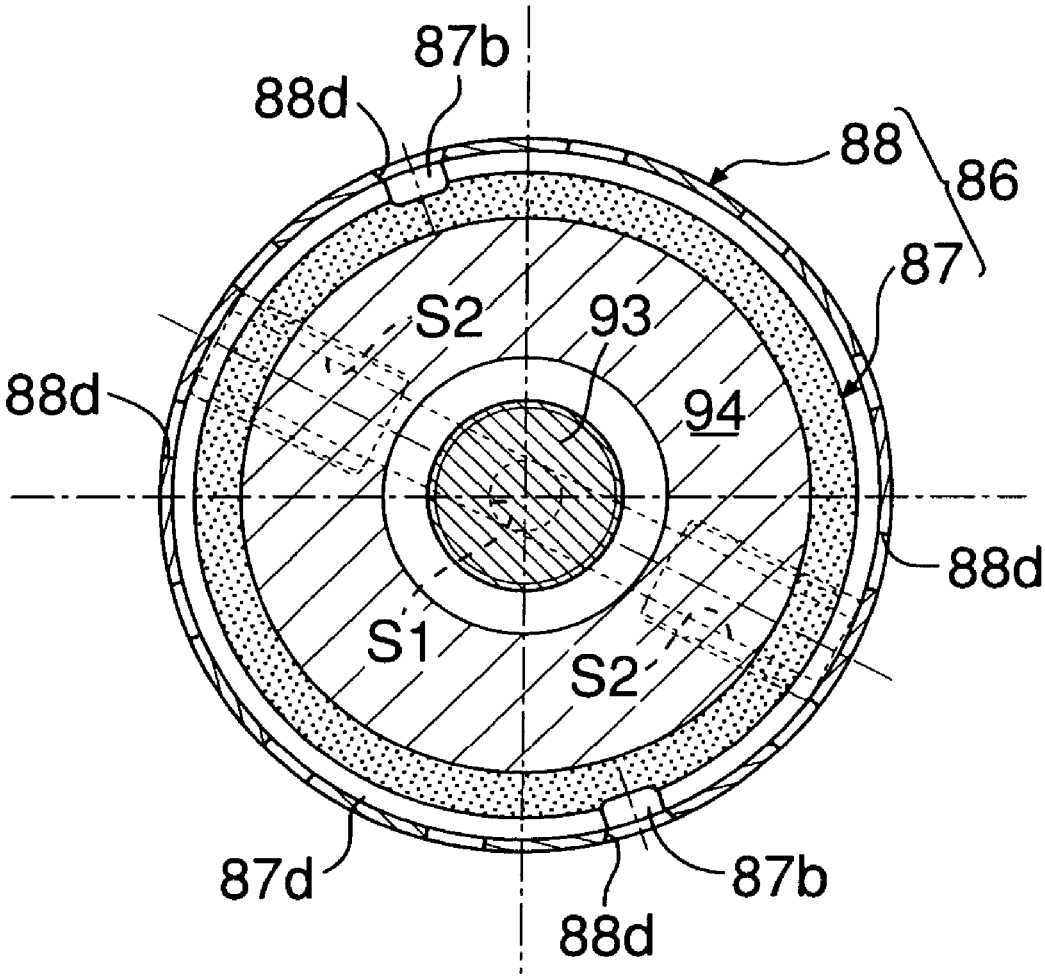

As is clear from FIG. 14 to FIG. 16, a plurality (twelve in the embodiment) of annularly disposed port holes 88*d* are formed at two positions of the outer sleeve 88 on either side of the rotary valve V, and two annularly disposed port channels 87*d* communicating with the port holes 88*d* are formed in the inner sleeve 87. The port holes 88*d* and the port channels 87*d* communicate with the transit chamber 19 via two passages 87*b* formed in the axis L direction on the mating surfaces of the inner sleeve 87 and the outer sleeve 88, an annular channel 87*c* formed in the inner sleeve 87, and a through hole 88*a* formed in the outer sleeve 88. Segmented spiral channels 88*b* extending in a spiral shape are formed axially outside the two lines of port holes 88*d* of the outer peripheral face of the outer sleeve 88. The directions of inclination of the spiral channels 88*b* on either side of the two lines of port holes 88*d* are opposite to each other. Two abraded powder collecting channels 88*c* are formed axially inside the two lines of port holes 88*d* on the outer peripheral face of the outer sleeve 88.

As is clear from FIG. 2, pressure chambers 110 are formed at the rear face of the ring seals 79 fitted in the circular seal channels 76 of the first and second casing halves 12 and 13. An eleventh water passage W11 formed in the first and second casing halves 12 and 13 communicates with the two pressure chambers 110 via a twelfth water passage W12 and a thirteenth water passage W13, which are formed from pipes, and the ring seals 79 are urged toward the side face of the rotor 41 by virtue of water pressure applied to the two pressure chambers 110.

The eleventh water passage W11 communicates with the outer peripheral face of the annular filter 30 via a fourteenth water passage W14, which is a pipe, and the inner peripheral face of the filter 30 communicates with a sixteenth water passage W16 formed in the second casing half 13 via a fifteenth water passage W15 formed in the second casing half 13. Water supplied to the sixteenth water passage W16 lubricates sliding surfaces between the outer sleeve 88 of the fixed shaft 102 and the inner sleeve 85 of the rotating shaft 113. Water supplied to the outer periphery of the bearing member 23 from the inner peripheral face of the filter 30 via a seventeenth water passage W17 lubricates the outer peripheral face of the outer sleeve 21 of the rotating shaft 113 through an orifice penetrating the bearing members 23, and also forms a hydrostatic bearing to support the rotating shaft 113 in a floating state, thereby reducing the frictional force and preventing seizing. On the other hand, water supplied to the outer periphery of the bearing members 22 from the eleventh water passage W11 via an eighteenth water passage W18, which is a pipe, lubricates the outer peripheral face of the outer sleeve 21 of the rotating shaft 113 through an orifice penetrating the bearing member 22, and also lubricates the sliding surfaces between the outer sleeve 88 of the fixed shaft 102 and the inner sleeve 85 of the rotating shaft 113.

Operation of the present embodiment having the above-mentioned arrangement is now explained.

Operation of the expander 4 is first explained. In FIG. 3, high temperature, high pressure steam from the evaporator 3 is supplied to the steam supply pipe 91, the first steam passage S1 passing through the center of the fixed shaft 102, and the pair of second steam passages S2 and S2 passing radially through the fixed shaft 102. In FIG. 10, when the inner sleeve 85 that rotates integrally with the rotor 41 and the outer sleeve 21 in the direction shown by the arrow R reaches a predetermined phase relative to the fixed shaft 102, the pair of third steam passages S3 that are present on the advanced side in the direction of rotation R of the rotor 41 relative to the position of the minor axis of the rotor chamber 14 are made to communicate with the pair of second steam passages S2, and the high temperature, high pressure steam of the second steam passages S2 is supplied to the interiors of a pair of the cylinders 44 via the third steam passages S3 and pushes the pistons 47 radially outward. In FIG. 4, when the vanes 48 pushed by the pistons 47 move radially outward, since the pair of rollers 71 provided on the vanes 48 are engaged with the annular channels 74, the forward movement of the pistons 47 is converted into rotational movement of the rotor 41.

Even after the communication between the second steam passages S2 and the third steam passages S3 is blocked as a result of the rotation of the rotor 41, the high temperature, high pressure steam within the cylinders 44 continues to expand, thus making the pistons 47 move further forward and thereby enabling the rotor 41 to continue to rotate. When the vanes 48 reach the position of the major axis of the rotor chamber 14, the third steam passages S3 communicating with the corresponding cylinders 44 also communicate with the pair of notches 86*a* formed on the outer peripheral face of the fixed sleeve 86, the pistons 47 are pushed by the vanes 48 whose rollers 71 are guided by the annular channels 74 and move radially inward, and the steam within the cylinders 44 accordingly passes through the third steam passages S3, the notches 86*a*, the fourth passages S4, the fifth passage S5, and the through holes 82*b* , and is supplied to the transit chamber 19 as a first decreased temperature, decreased pressure steam. The first decreased temperature, decreased pressure steam is the high temperature, high pressure steam that has been supplied from the steam supply pipe 91, has finished work of driving the pistons 47 and, as a result, has a decreased temperature and pressure. The thermal energy and the pressure energy of the first decreased temperature, decreased pressure steam are lower than those of the high temperature, high pressure steam, but are still sufficient for driving the vanes 48.

The first decreased temperature, decreased pressure steam within the transit chamber 19 is supplied to the vane chambers 75 within the rotor chamber 14 via the intake ports 108 of the first and second casing halves 12 and 13, and further expands therein to push the vanes 48, thus rotating the rotor 41. A second decreased temperature, decreased pressure steam that has finished the work and accordingly has a further decreased temperature and pressure is discharged from the exhaust ports 109 of the second casing half 13 into the exhaust chamber 20, and is supplied therefrom to the condenser 5.

In this way, the expansion of the high temperature, high pressure steam enables the twelve pistons 47 to operate in turn to rotate the rotor 41 via the rollers 71 and the annular channels 74, and the expansion of the first decreased temperature, decreased pressure steam, which is the high temperature, high pressure steam whose temperature and pressure have decreased, enables the rotor 41 to rotate via the vanes 48, thereby providing an output from the rotating shaft 113.

Lubrication of the vanes 48 and the pistons 47 of the expander 4 with water is now explained.

Lubricating water is supplied using the supply pump 6 (see FIG. 1) for supplying water under pressure from the condenser 5 to the evaporator 3, and a portion of the water discharged by the supply pump 6 is supplied to the first water passage W1 of the casing 11 for the purpose of lubrication. Such use of the supply pump 6 for supplying water to the hydrostatic bearing of each section of the expander 4 eliminates the need for a special pump and enables the number of components to be reduced.

In FIG. 3 and FIG. 8, the water that has been supplied to the first water passage W1 of the lubricating water supply member 24 flows into the small diameter portion 55*a* of one of the pipe members 55 via the second water passages W2 of the seal block 25, the third water passages W3 of the outer sleeve 21, the annular channel 68*a* of the water passage forming member 68, the fourth water passage W4 of the outer sleeve 21, and the fifth water passages W5 formed in the pipe member 69 and the rotor segment 43, and the water that has flowed into the small diameter portion 55*a* flows into the small diameter portion 56*a* of the other pipe member 56 via the through hole 55*b* of said one of the pipe members 55, the sixth water passage W6 formed in the pipe members 55 and 56, and the through hole 56*b* formed in the other pipe member 56.

A portion of the water that has passed through the six orifices 61*b*, 61*c*, and 61*d* of the orifice-forming plate 61 from the small diameter portions 55*a* and 56*a* of the pipe members 55 and 56 via the distribution channel 62*b* of the lubricating water distribution member 62 issues from the four lubricating water outlets 43*e* and 43*f* that open on the end faces of the rotor segment 43, and another portion of the water issues from the lubricating water outlets 43*c* and 43*d* within the arc-shaped recesses 43*a* and 43*b* formed on the side faces of the rotor segment 43.

In this way, the water issuing from the lubricating water outlets 43*e* and 43*f* on the end faces of each of the rotor segments 43 into the vane channel 49 supports the vane 48 in a floating state by forming a hydrostatic bearing between the vane channel 49 and the vane 48, which is slidably fitted in the vane channel 49, thus preventing physical contact between the end face of the rotor segment 43 and the vane 48 and thereby preventing the occurrence of seizing and wear. Supplying the water for lubricating the sliding surfaces of the vane 48 via the water passages provided in a radial shape within the rotor 41 in this way not only enables the water to be pressurized by virtue of centrifugal force but also enables the temperature of the periphery of the rotor 41 to be stabilized, thus lessening the effect of thermal expansion and thereby minimizing the leakage of steam by maintaining a preset clearance.

Since water is retained in the recesses 48*e*, two of which are formed on each of the opposite faces of the vane 48, these recesses 48*e* function as pressure reservoirs, thereby suppressing any decrease in pressure due to leakage of water. As a result the vane 48, which is held between the end faces of the pair of rotor segments 43, is in a floating state due to the water, and the sliding resistance can thereby be reduced effectively. Furthermore, when the vane 48 reciprocates, the radial position of the vane 48 relative to the rotor 41 changes, and since the recesses 48*e* are provided not on the rotor segment 43 side but on the vane 48 side and in the vicinity of the rollers 71, where the largest load is imposed on the vane 48, the reciprocating vane 48 can always be kept in a floating state, and the sliding resistance can thereby be reduced effectively.

The water that has lubricated the sliding surfaces of the vane 48 that are opposite the rotor segments 43 moves radially outward by virtue of centrifugal force and lubricates the sliding section between the seal 72 provided on the arc-shaped face 48*b* of the vane 48 and the arc-shaped face 14*b* of the rotor chamber 14. Water that has finished lubricating is discharged from the rotor chamber 14 via the exhaust ports 109.

In FIG. 2, by supplying water into the pressure chambers 110 at the bottom portions of the circular seal channels 76 of the first casing half 12 and the second casing half 13 so as to urge the ring seals 79 toward the side faces of the rotor 41, and making the water issue from the lubricating water outlets 43*c* and 43*d* formed within the recesses 43*a* and 43*b* of each of the rotor segments 43 so as to form a hydrostatic bearing on the sliding surfaces with the flat faces 14*a* of the rotor chamber 14, the flat faces 41*a* of the rotor 41 can be sealed by the ring seals 79 that are in a floating state within the circular seal channels 76 and, as a result, the steam within the rotor chamber 14 can be prevented from leaking through a gap with the rotor 41. In this process, the ring seals 79 and the rotor 41 are isolated from each other by a film of water supplied from the lubricating water outlets 43*c* and 43*d* and do not make physical contact with each other, and even if the rotor 41 tilts, the damping effect of the ring seals 79 tracking the tilting within the circular seal channels 76 enables stable sealing characteristics to be maintained while minimizing the frictional force.

The water that has lubricated the sliding section between the ring seals 79 and the rotor 41 is supplied to the rotor chamber 14 by virtue of centrifugal force, and discharged therefrom to the exterior of the casing 11 via the exhaust ports 109.

Furthermore, in FIG. 5, water that has been supplied from the sixth water passage W6 within the pipe member 55 to the sliding surfaces between the cylinder 44 and the piston 47 via the tenth water passage W10 within the rotor segments 43 and the annular channel 67 of the outer periphery of the cylinder 44 exhibits a sealing function by virtue of the viscous properties of the film of water formed on the sliding surfaces, thereby preventing effectively the high temperature, high pressure steam supplied to the cylinder 44 from leaking past the sliding surfaces with the piston 47. Since the water that is supplied to the sliding surfaces between the cylinder 44 and the piston 47 through the interior of the expander 4, which is in a high temperature state, is heated, it is possible to minimize any decrease in output of the expander 4 that might be caused by this water cooling the high temperature, high pressure steam supplied to the cylinder 44.

Moreover, since water, which is the same substance as steam, is used as a medium for sealing, there will be no problem even when the steam is contaminated with water. If the sliding surfaces of the cylinder 44 and the piston 47 were sealed by an oil, since it would be impossible to prevent the oil from contaminating the water or steam, a special filter device for separating the oil would be required. Furthermore, since a portion of the water for lubricating the sliding surfaces of the vane 48 and the vane channels 49 is separated for sealing the sliding surfaces of the cylinder 44 and the piston 47, it is unnecessary to specially provide an extra water passage for guiding the water to the sliding surfaces, thus simplifying the structure.

In order to maintain the sealing characteristics for the steam in the rotary valve V, it is necessary to precisely control the clearance between the sliding surfaces of the rotating shaft 113 and the fixed shaft 102. When the expander 4 is cold, the fixed shaft 102, through which the high temperature steam passes, first expands thermally in the vicinity of the rotary valve V, the rotating shaft 113 then thermally expands after a time lag, and the difference in thermal expansion causes wear of the outer peripheral face of the fixed shaft 102. During this process, if the fixed shaft 102 is firmly fixed to the casing 11, rotational runout of the rotor 41 results in uneven contact with the outer peripheral face of the fixed shaft 102, thereby causing eccentric wear, and giving rise to problems such as degradation of the sealing characteristics for the steam in the rotary valve V, an increase in the sliding resistance, and degradation in the rotational behavior of the rotor 41.

However, in accordance with the present embodiment, since the fixed shaft 102 is floatingly supported by the fixed shaft support spring 95 relative to the casing 11, when the rotational runout of the rotor 41 is transmitted to the fixed shaft 102 via the rotating shaft 113, the alignment action arising from tracking exhibited by the damping effect of the fixed shaft support spring 95 suppresses the rotational runout of the rotor 41, and any increase in the frictional resistance in the sliding section between the fixed shaft 102 and the rotating shaft 113 and the occurrence of abnormal wear can be prevented effectively. In this way, if the outer peripheral face of the fixed shaft 102 is uniformly worn by the action of the fixed shaft support spring 95, the clearance of the uniformly worn section of the fixed shaft 102 is uniformly reduced when the expander 4 is hot, and the sealing characteristics of the rotary valve V can be ensured. Since the left-hand end of the fixed shaft 102 is supported via the Oldham coupling 89 in a non-rotatable but radially movable manner, the alignment action of the fixed shaft 102 due to the tracking exhibited by the damping effect of the fixed shaft support spring 95 can be exhibited without any problem.

Suppressing the thermal expansion of the fixed shaft 102 due to the heat of the steam to a low level enables wear of the outer peripheral face of the fixed shaft 102 in the vicinity of the rotary valve V to be further reduced. In the present embodiment, the fixed sleeve 86 is therefore formed by shrink-fitting the outer sleeve 88, which is made of metal, around the outer periphery of the inner sleeve 87, which is made of ceramic, etc. having a small coefficient of thermal expansion.

Figure 20A:
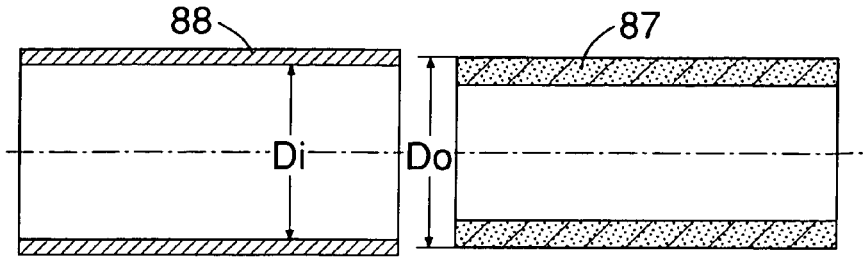
FIG. 20A to FIG. 20D are diagrams for explaining the operation when a fixed sleeve is shrink-fitted.
Figure 20B:
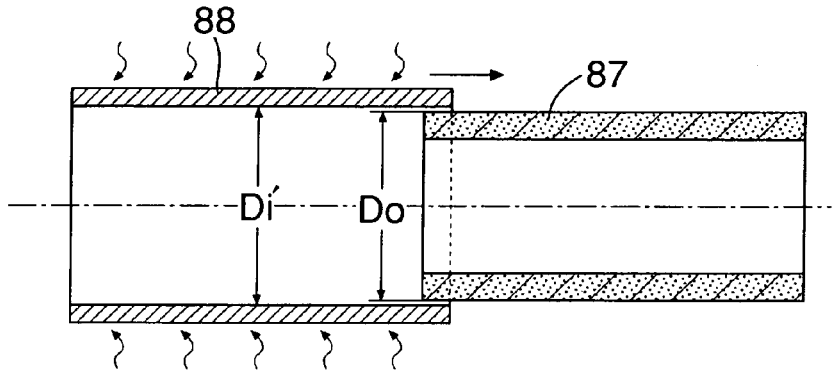
Figure 20C:
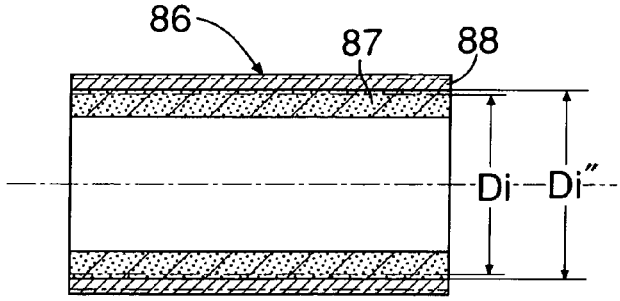

That is, as shown in FIG. 20A, the outer diameter Do of the inner sleeve 87 is larger than the inner diameter Di of the outer sleeve 88 at room temperature, and the outer sleeve 88 is fitted around the outer periphery of the inner sleeve 87 in a state, as shown in FIG. 20B, in which the inner diameter Di' thereof is made larger than the outer diameter Do of the inner sleeve 87 by heating the outer sleeve 88, which is made of metal, so as to thermally expand it. When the outer sleeve 88 is cooled so as to shrink it in this state, the inner peripheral face of the outer sleeve 88 comes into intimate contact with the outer peripheral face of the inner sleeve 87 as shown in FIG. 20C, thus completing the shrink-fitting. In a state in which the shrink-fitting is completed, the outer sleeve 88, whose inner diameter should have decreased to Di (broken line), is restrained by the inner sleeve 87, and the inner diameter only decreases to an inner diameter D", which is larger than the above Di (Di <Di"<D'), and the outer sleeve 88 is in a state in which an internal stress acts on it in a tensile direction.

Figure 20D:
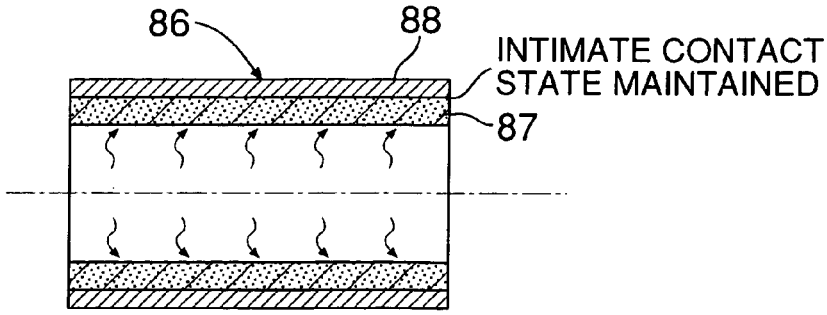

Therefore, as shown in FIG. 20D, when the outer sleeve 88 and the inner sleeve 87 are heated by steam, the thermal expansion of the outer sleeve 88 is canceled by the internal stress in the tensile direction, and the outer diameter of the outer sleeve 88 does not increase substantially. In practice, the outer diameter of the outer sleeve 88 is controlled by the small amount of thermal expansion of the inner sleeve 87, which is made of ceramic, etc. having a small coefficient of thermal expansion, and increases slightly due to being widened by the inner sleeve 87. In this way, since the change due to thermal expansion in the outer diameter of the fixed sleeve 86 having the outer sleeve 88, which is a collar made of an easily stretched metal and is in sliding contact with the inner sleeve 85 of the rotating shaft 113, can be suppressed by shrink-fitting, wear of the outer peripheral face of the fixed sleeve 86 can be minimized, thereby preventing the leakage of steam from the rotary valve V.

Since the outer sleeve 88 of the fixed sleeve 86 is made of metal, a coating of a low friction material, which is difficult to apply to a ceramic sleeve, can be applied to the outer sleeve 88 and this, together with the structure of the shrink-fitting on the rotating shaft 113 side, enables the frictional resistance between the outer sleeve 88 and the inner sleeve 85 to be further reduced, thus suppressing any increase in the clearance and reducing the leakage of steam.

In the same way as for the fixed sleeve 86 of the above-mentioned fixed shaft 102, the rotating shaft 113 is also formed by uniting the outer sleeve 21, which is made of metal, with the outer periphery of the ceramic inner sleeve 85 by shrink-fitting, and the outer sleeve 21 is in a state in which an internal stress acts in the tensile direction.

The effect of the shrink-fitting is now explained with reference to FIG. 21A to FIG. 21D.

Figure 21A:
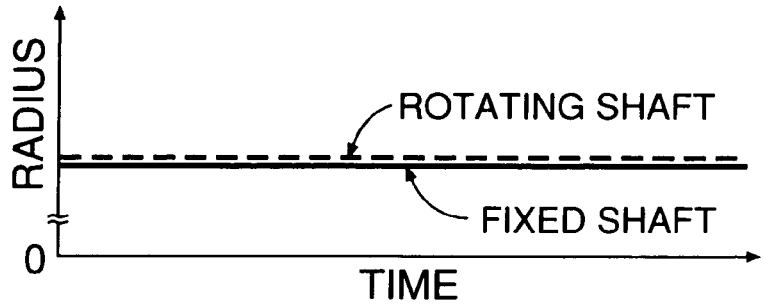
Figure 21B:
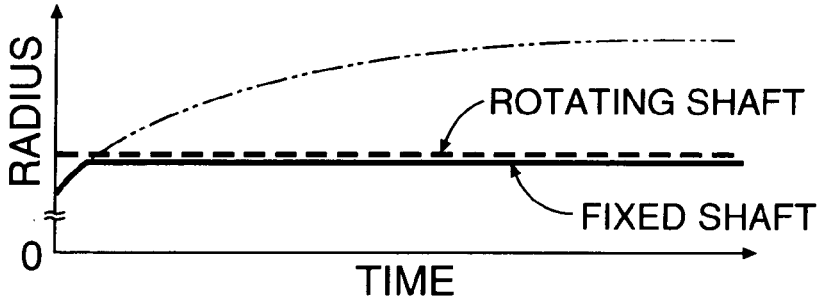
Figure 21C:
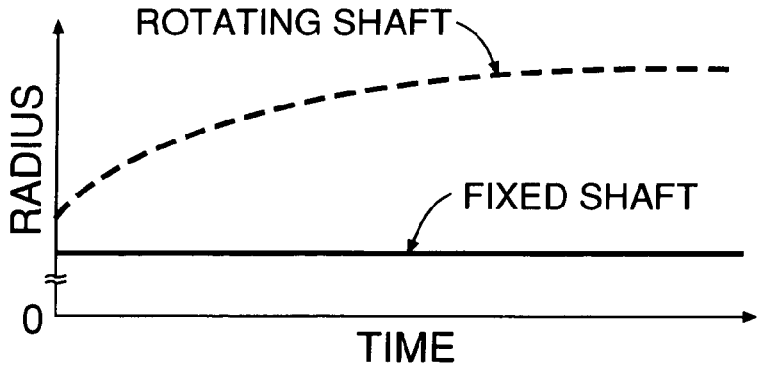
Figure 21D:
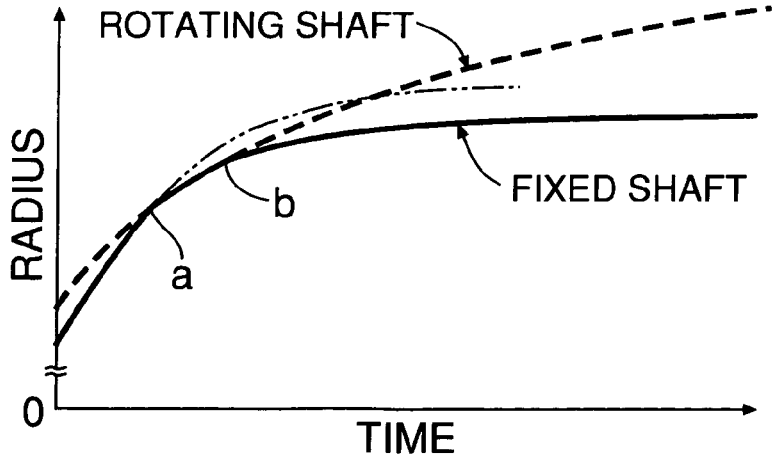

FIG. 21D corresponds to a conventional example in which both the rotating shaft 113 and the fixed shaft 102 are made of metal, and when high temperature steam is supplied to the rotary valve V through the interior of the fixed shaft 102 when it is cold, the fixed shaft 102 side first expands thermally to a large extent and comes into contact with the inner peripheral face of the rotating shaft 113, and wear of the sliding surfaces occurs between point a and point b. This wear occurs only when running the expander 4 for the first time after assembly. When, after time has elapsed, it is hot, that is, when the temperatures of both the fixed shaft 102 and the rotating shaft 113 are sufficiently high, the amount of expansion of the rotating shaft 113 becomes larger than the amount of expansion of the fixed shaft 102, and the clearance therebetween gradually enlarges. In this way, in the conventional arrangement, both the fixed shaft 102 and the rotating shaft 113 expand thermally, thus generating wear of the sliding surfaces and increasing the clearance when hot.

On the other hand, FIG. 21A shows the characteristics of the present embodiment in which shrink-fitting is employed for both the rotating shaft 113 and the fixed shaft 102. The radii of the rotating shaft 113 and the fixed shaft 102 hardly change from when they are cold to when they are hot, and the clearance between the sliding surfaces thereof is always maintained substantially constant.

FIG. 21B shows the characteristics when shrink-fitting is employed only for the rotating shaft 113 side. The fixed shaft 102 side expands thermally accompanying the starting of the supply of steam and comes into contact with the inner peripheral face of the rotating shaft 113, which hardly expands at all, thereby generating wear on the outer peripheral face of the fixed shaft 102. This wear occurs only when running the expander 4 for the first time after assembly, and once bedding in due to the wear is completed, the clearance between the sliding surfaces is always maintained substantially constant in subsequent running.

FIG. 21C shows the characteristics when shrink-fitting is employed only for the fixed shaft 102 side. The rotating shaft 113 side expands thermally accompanying the starting of the supply of steam and the clearance between itself and the rotating shaft 113, which hardly expands at all thermally, gradually increases, but since contact between the fixed shaft 102 and the rotating shaft 113 is avoided, wear will not be caused, and the sliding resistance therebetween can be minimized.

As hereinbefore described, the maximum effect can be obtained when shrink-fitting is employed for both the rotating shaft 113 and the fixed shaft 102, and the expected effect can also be obtained when shrink-fitting is employed for only one of the rotating shaft 113 or the fixed shaft 102.

Even if an attempt is made to prevent the steam from leaking from the rotary valve V as described above, it is impossible to prevent a slight amount of steam from leaking past the sliding surfaces of the rotating shaft 113 and the fixed shaft 102. This leaked steam is captured by the port holes 88*d* and the port channels 87*d* annularly formed on the outer peripheral face of the fixed sleeve 86, and is supplied therefrom to the transit chamber 19 via the two passages 87*b* formed on the mating surfaces between the inner sleeve 87 and the outer sleeve 88, the annular channel 87*c* formed in the inner sleeve 87, and the through hole 88*a* formed in the outer sleeve 88. The steam that has been supplied to the transit chamber 19 is combined with the first decreased temperature, decreased pressure steam that has finished driving the pistons 47, and is provided for driving the vanes 48. In this way, the steam that has leaked from the rotary valve V is captured by the port holes 88*d* and the port channels 87*d* and reused, thereby contributing an improvement of the overall energy efficiency of the expander 4.

When the outer sleeve 88, which is made of metal, of the fixed sleeve 86 is worn due to sliding against the ceramic inner sleeve 85 of the rotating shaft 113, the abraded powder thus formed is collected by the abraded powder collecting channels 88*c* formed on the outer peripheral face of the outer sleeve 88, and thereby prevented from accumulating on the sliding surfaces of the fixed sleeve 86 and the inner sleeve 85 of rotating shaft 113. It is thereby possible to avoid any increase in the frictional resistance and the occurrence of seizure of the sliding surfaces.

If the water that has been supplied from the sixteenth water passage W16 and lubricated the sliding surfaces of the fixed sleeve 86 and the inner sleeve 85 of the rotating shaft 113 and the water that has lubricated the outer peripheral face of the rotating shaft 113 through the orifice penetrating the bearing members 22 and 23 and has also lubricated the sliding surfaces of the fixed sleeve 86 and the inner sleeve 85 of the rotating shaft 113 were to flow into the transit chamber 19 via the port holes 88*d* and the port channels 87*d* formed in the outer periphery of the fixed sleeve 86, the first decreased temperature, decreased pressure steam within the transit chamber 19 might be cooled, and the output of the expander 4 might be degraded.

However, in accordance with the present embodiment, when the water that lubricates the sliding surfaces of the fixed sleeve 86 and the inner sleeve 85 of the rotating shaft 113 flows from opposite ends of the fixed sleeve 86 toward the port holes 88*d* and the port channels 87*d* in the center, the spiral channels 88*b* formed on the outer periphery of the outer sleeve 88 can exhibit an effect of generating a pressure so as to push back the lubricating water away from the port holes 88*d* and the port channels 87*d*. That is, as a result of the relative rotation between the inner sleeve 85 of the rotating shaft 113 and the fixed sleeve 86 the lubricating water retained in the spiral channels 88*b* is pressurized by a spring pump action and pushed back in a direction away from the port holes 88*d* and the port channels.

If the spiral channels 88*b* were made to communicate with the port holes 88*d* and the port channels 87*d* without being sectioned into short lengths, there is the possibility that high pressure lubricating water might pass through the interior of the spiral channels 88*b* without being stopped and flow into the low pressure port holes 88*d* and the port channels 87*d*, but this problem can be solved by sectioning the spiral channels 88*b* into short lengths.

Furthermore, the first water passage W1 and the eleventh water passage W11 are independent from each other, and water is supplied at a pressure that is required for each of the lubrication sections. More specifically, the water that is supplied from the first water passage W1 is mainly for floatingly supporting the vanes 48 and the rotor 41 by means of a hydrostatic bearing as described above, and it is required to have a high pressure that can counterbalance variations in the load. In contrast, the water that is supplied from the eleventh water passage W11 mainly lubricates the surroundings of the fixed shaft 102 and the bearing members 22 and 23 and also forms a hydrostatic bearing, and since it is for sealing the high temperature, high pressure steam that leaks from the third steam passages S3 and S3 past the outer periphery of the fixed shaft 102 so as to reduce the influence of thermal expansion of the fixed shaft 102, the rotating shaft 113, the rotor 41, etc., it is required to have a pressure that is at least higher than the pressure of the transit chamber 19.

Since there are provided in this way two water supply lines, that is, the first water passage W1 for supplying high pressure water and the eleventh water passage W11 for supplying lower pressure water, problems caused when only one water supply line for supplying high pressure water is provided can be eliminated. That is, the problem of water having excess pressure being supplied to the surroundings of the fixed shaft 102, thus increasing the amount of water flowing into the transit chamber 19, and the problem of the fixed shaft 102, the rotating shaft 113, the rotor 41, etc. being overcooled, thus decreasing the temperature of the steam, can be prevented, and as a result the output of the expander 4 can be increased while reducing the amount of water supplied.

Other than the embodiment described above, as an arrangement for a power conversion device for converting the forward movement of pistons 47 into the rotational movement of a rotor 41, the forward movement of the pistons 47 can be directly transmitted to rollers 71 without involving vanes 48, and can be converted into rotational movement by engagement with annular channels 74. Furthermore, as long as the vanes 48 are always spaced from the inner peripheral face of a rotor chamber 14 by a substantially constant gap as a result of cooperation between the rollers 71 and the annular channels 74 as described above, the pistons 47 and the rollers 71, and also the vanes 48 and the rollers 71, can independently work together with the annular channels 74.

When the expander 4 is used as a compressor, the rotor 41 is rotated by the rotating shaft 113 in a direction opposite to the arrow R in FIG. 4, outside air is drawn in by the vanes 48 from the exhaust ports 109 into the rotor chamber 14 and compressed, and the low pressure compressed air thus obtained is drawn in from the intake ports 108 into the cylinders 44 via the transit chamber 19, the through holes 82*b*, the fifth steam passages S5, the fourth steam passages S4, the notches 86*a* of the fixed shaft 102 and the third steam passages S3, and compressed there by the pistons 47 to give high pressure compressed air. The high pressure compressed air thus obtained is discharged from the cylinders 44 via the third steam passages S3, the second steam passages S2, the first steam passage S1, and the steam supply pipe 91. When the expander 4 is used as a compressor, the steam passages S1 to S5 and the steam supply pipe 91 are read instead as air passages S1 to S5 and air supply pipe 91.

Although an embodiment of the present invention are described in detail above, the present invention can be modified in a variety of ways without departing from the scope and spirit thereof.

For example, in the embodiment, the expander 4 is illustrated as the rotary fluid machine, but the present invention can also be applied to a compressor.

Furthermore, in the embodiment, steam and water are used as the gas-phase working medium and the liquid-phase working medium, but other appropriate working media can also be employed.

Moreover, in the embodiment, the first water passage W1 for supplying water for lubricating the sliding surfaces of the vanes 48 and the vane channels 49 and the eleventh water passage W11 for supplying water for lubricating the sliding surfaces of the rotating shaft 113 and the fixed shaft 102 are separated at the entrance of the expander 4, but water that is supplied from a single line water passage can be converted and branched into a high pressure line and a low pressure line within the expander 4.

INDUSTRIAL APPLICABILITY

The present invention can desirably be applied to an expander employing steam (water) as a working medium, but can also be applied to an expander employing any other working medium and a compressor employing any working medium.

What is claimed is:

1. A rotary fluid machine comprising a rotor chamber (14) formed in a casing (11), a rotor (41) rotatably housed within the rotor chamber (14), and a plurality of vane piston units supported on the rotor (41) so as to be radially moveable, the vane piston units comprising a vane (48) that is guided along a vane channel (49) formed in the rotor (41) and slides within the rotor chamber (14), and a piston (47) that is fitted slidably in a cylinder (44) provided in the rotor (41) and abuts against a non-sliding side of the vane (48);

the pressure energy of a gas-phase working medium and the rotational energy of the rotor (41) being interconverted via a power conversion device by reciprocation of the piston (47), and the pressure energy of the gas-phase working medium and the rotational energy of the rotor (41) being interconverted by rotation of the vane (48);

characterized in that a rotating shaft (113) fixed to the rotor (41) is rotatably supported on a bearing member (22, 23) and a fixed shaft (102) fixed to the casing (11), sliding surfaces of the fixed shaft (102) and the bearing member (22, 23) with the rotating shaft (113) are lubricated with a first pressurized liquid-phase working medium, and sliding surfaces of the vane channel (49) and the vane (48) are lubricated with a second pressurized liquid-phase working medium;

the pressure of the first pressurized liquid-phase working medium and the pressure of the second pressurized liquid-phase working medium being made different.

2. The rotary fluid machine according to claim 1, wherein the pressure of the first pressurized liquid-phase working medium is set lower than the pressure of the second pressurized liquid-phase working medium.

* * * * *